US010728678B2

(12) United States Patent
Edwards

(10) Patent No.: US 10,728,678 B2
(45) **Date of Patent: *Jul. 28, 2020**

(54) METHOD AND APPARATUS FOR A BINAURAL HEARING ASSISTANCE SYSTEM USING MONAURAL AUDIO SIGNALS

(71) Applicant: Starkey Laboratories, Inc., Eden Prairie, MN (US)

(72) Inventor: Brent Edwards, San Francisco, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/670,332

(22) Filed: Oct. 31, 2019

(65) Prior Publication Data

US 2020/0068320 A1 Feb. 27, 2020

Related U.S. Application Data

(63) Continuation of application No. 16/057,168, filed on Aug. 7, 2018, now Pat. No. 10,469,960, which is a (Continued)

(51) Int. Cl.
*H04R 25/00* (2006.01)
*H04S 1/00* (2006.01)
*H04S 5/00* (2006.01)

(52) U.S. Cl.
CPC ..... *H04R 25/552* (2013.01); *H04R 25/554* (2013.01); *H04S 1/005* (2013.01); (Continued)

(58) Field of Classification Search
CPC .. H04R 25/552; H04R 25/554; H04R 25/558; H04S 1/005; H04S 2420/01; H04S 5/00; H04S 2400/01
USPC ..... 381/23.1, 17, 74, 77, 80, 81, 309, 311, 381/312, 315
See application file for complete search history.

(56) References Cited

U.S. PATENT DOCUMENTS 2,530,621 A 11/1950 Lybarger
2,554,834 A 5/1951 Lavery
(Continued)

FOREIGN PATENT DOCUMENTS

CH 670349 A5 5/1989
CH 673551 A5 3/1990
(Continued)

OTHER PUBLICATIONS

US 8,175,281 B2, 05/2012, Edwards (withdrawn)
(Continued)

*Primary Examiner* — Paul Kim
(74) *Attorney, Agent, or Firm* — Schwegman Lundberg & Woessner, P.A.

(57) ABSTRACT

The present application provides method and apparatus for a binaural hearing assistance system using a monaural audio signal input. The system, in various examples, provides adjustable delay/phase adjustment and sound level adjustment. Different embodiments are provided for receiving the monaural signal and distributing it to a plurality of hearing assistance devices. Different relaying modes are provided. Special functions are supported, such as telecoil functions. The system also has examples that account for a head-related transfer function in providing advanced sound processing for the wearer. Other examples are provided that are described in the detailed description.

20 Claims, 6 Drawing Sheets

Related U.S. Application Data continuation of application No. 15/362,447, filed on Nov. 28, 2016, now Pat. No. 10,051,385, which is a continuation of application No. 14/714,792, filed on May 18, 2015, now Pat. No. 9,510,111, which is a continuation of application No. 13/464,419, filed on May 4, 2012, now Pat. No. 9,036,823, which is a continuation of application No. 11/456,538, filed on Jul. 10, 2006, now Pat. No. 8,208,642.

(52) U.S. Cl.
CPC ..... *H04R 25/558* (2013.01); *H04S 5/00* (2013.01); *H04S 2400/01* (2013.01); *H04S 2420/01* (2013.01)

(56) References Cited

U.S. PATENT DOCUMENTS 2,656,421 A 10/1953 Lybarger
3,396,245 A 8/1968 Flygstad
3,527,901 A 9/1970 Geib
3,571,514 A 3/1971 Wruk
3,660,695 A 5/1972 Schmitt
3,742,359 A 6/1973 Behymer
3,770,911 A 11/1973 Knowles et al.
3,798,390 A 3/1974 Gage et al.
3,836,732 A 9/1974 Johanson et al.
3,875,349 A 4/1975 Ruegg
3,894,196 A 7/1975 Briskey
3,946,168 A 3/1976 Preves
3,975,599 A 8/1976 Johanson
4,051,330 A 9/1977 Cole
4,142,072 A 2/1979 Berland
4,187,413 A 2/1980 Moser
4,366,349 A 12/1982 Adelman
4,395,601 A 7/1983 Kopke et al.
4,396,806 A 8/1983 Anderson
4,419,544 A 12/1983 Adelman
4,425,481 A 1/1984 Mansgold et al.
4,449,018 A 5/1984 Stanton
4,456,795 A 6/1984 Saito
4,467,145 A 8/1984 Borstel
4,471,490 A 9/1984 Bellafiore
4,489,330 A 12/1984 Marutake et al.
4,490,585 A 12/1984 Tanaka
4,508,940 A 4/1985 Steeger
4,596,899 A 6/1986 Wojcik et al.
4,622,440 A 11/1986 Slavin
4,631,419 A 12/1986 Sadamatsu et al.
4,637,402 A 1/1987 Adelman
4,638,125 A 1/1987 Buettner
4,696,032 A 9/1987 Levy
4,710,961 A 12/1987 Buttner
4,712,244 A 12/1987 Zwicker et al.
4,723,293 A 2/1988 Harless
4,751,738 A 6/1988 Widrow et al.
4,756,312 A 7/1988 Epley
4,764,957 A 8/1988 Angelini et al.
4,845,755 A 7/1989 Busch et al.
4,862,509 A 8/1989 Towsend
4,882,762 A 11/1989 Waldhauer
4,887,299 A 12/1989 Cummins et al.
4,926,464 A 5/1990 Schley-May
4,930,156 A 5/1990 Norris
4,995,085 A 2/1991 Kern et al.
5,010,575 A 4/1991 Marutake et al.
5,027,410 A 6/1991 Williamson et al.
5,029,215 A 7/1991 Miller, II
5,083,312 A 1/1992 Newton et al.
5,086,464 A 2/1992 Groppe
5,091,952 A 2/1992 Williamson et al.
5,157,405 A 10/1992 Wycoff et al.
5,189,704 A 2/1993 Krauss
5,204,917 A 4/1993 Arndt et al.
5,212,827 A 5/1993 Meszko et al.
5,214,709 A 5/1993 Ribic
5,226,087 A 7/1993 Ono et al.
5,280,524 A 1/1994 Norris
5,289,544 A 2/1994 Franklin
5,390,254 A 2/1995 Adelman
5,404,407 A 4/1995 Weiss
5,422,628 A 6/1995 Rodgers
5,425,104 A 6/1995 Shennib
5,426,689 A 6/1995 Griffith et al.
5,434,924 A * 7/1995 Jampolsky ..... H04R 25/502 381/17
5,463,692 A 10/1995 Fackler
5,479,522 A 12/1995 Lindemann et al.
5,483,599 A 1/1996 Zagorski
5,502,769 A 3/1996 Gilbertson
5,524,056 A 6/1996 Killion et al.
5,553,152 A 9/1996 Newton
5,581,747 A 12/1996 Anderson
5,600,728 A 2/1997 Satre
5,629,985 A 5/1997 Thompson
5,636,285 A 6/1997 Sauer
5,640,293 A 6/1997 Dawes et al.
5,640,457 A 6/1997 Gnecco et al.
5,651,071 A 7/1997 Lindemann et al.
5,659,621 A 8/1997 Newton
5,687,242 A 11/1997 Iburg
5,706,351 A 1/1998 Weinfurtner
5,710,820 A 1/1998 Martin et al.
5,721,783 A 2/1998 Anderson
5,734,976 A 3/1998 Bartschi et al.
5,737,430 A 4/1998 Widrow
5,740,257 A 4/1998 Marcus
5,751,820 A 5/1998 Taenzer
5,757,932 A 5/1998 Lindemann et al.
5,757,933 A 5/1998 Preves et al.
5,761,319 A 6/1998 Dar et al.
5,768,397 A 6/1998 Fazio
5,793,875 A 8/1998 Lehr et al.
5,796,848 A 8/1998 Martin
5,798,390 A 8/1998 Weber et al.
5,809,151 A 9/1998 Husung
5,822,442 A 10/1998 Agnew et al.
5,823,610 A 10/1998 Ryan et al.
5,825,631 A 10/1998 Prchal
5,835,610 A 11/1998 Ishige et al.
5,835,611 A 11/1998 Kaiser et al.
5,852,668 A 12/1998 Ishige et al.
5,862,238 A 1/1999 Agnew et al.
5,956,330 A 9/1999 Kerns
5,966,639 A 10/1999 Goldberg et al.
5,991,419 A 11/1999 Brander
5,991,420 A 11/1999 Stern
6,021,207 A 2/2000 Puthuff et al.
6,031,922 A 2/2000 Tibbetts
6,031,923 A 2/2000 Gnecco et al.
6,041,129 A 3/2000 Adelman
6,067,445 A 5/2000 Gray et al.
6,078,675 A 6/2000 Bowen-Nielsen et al.
6,078,825 A 6/2000 Hahn et al.
6,088,339 A 7/2000 Meyer
6,101,258 A 8/2000 Killion et al.
6,104,821 A 8/2000 Husung
6,115,478 A 9/2000 Schneider
6,118,877 A 9/2000 Lindemann et al.
6,144,748 A 11/2000 Kerns
6,148,087 A 11/2000 Martin
6,157,727 A 12/2000 Rueda
6,157,728 A 12/2000 Tong et al.
6,175,633 B1 1/2001 Morrill et al.
6,216,040 B1 4/2001 Harrison
6,230,029 B1 5/2001 Hahn et al.
6,236,731 B1 5/2001 Brennan et al.
6,240,192 B1 5/2001 Brennan et al.
6,240,194 B1 5/2001 De Koning
6,310,556 B1 10/2001 Green et al.
6,311,155 B1 10/2001 Vaudrey et al.
6,324,291 B1 11/2001 Weidner
6,327,370 B1 12/2001 Killion et al.

(56) References Cited

U.S. PATENT DOCUMENTS 6,347,148 B1 2/2002 Brennan et al.
6,356,741 B1 3/2002 Bilotti et al.
6,366,863 B1 4/2002 Bye et al.
6,381,308 B1 4/2002 Cargo et al.
6,389,142 B1 5/2002 Hagen et al.
6,438,245 B1 8/2002 Taenzer et al.
6,449,662 B1 9/2002 Armitage
6,459,882 B1 10/2002 Palermo et al.
6,466,679 B1 10/2002 Husung
6,522,764 B1 2/2003 Bogeskov-Jensen
6,549,633 B1 4/2003 Westermann
6,633,645 B2 10/2003 Bren et al.
6,694,034 B2 2/2004 Julstrom et al.
6,760,457 B1 7/2004 Bren et al.
7,016,511 B1 3/2006 Shennib
7,062,223 B2 6/2006 Gerber et al.
7,075,903 B1 7/2006 Solum
7,099,486 B2 8/2006 Julstrom et al.
7,103,191 B1 9/2006 Killion
7,116,792 B1 10/2006 Taenzer et al.
7,139,404 B2 11/2006 Feeley et al.
7,142,814 B2 11/2006 Nassimi
7,149,552 B2 12/2006 Lair
7,162,381 B2 1/2007 Boor et al.
7,181,032 B2 2/2007 Jakob et al.
7,248,713 B2 7/2007 Bren et al.
7,257,372 B2 8/2007 Kaltenbach et al.
7,260,233 B2 8/2007 Svendsen et al.
7,317,997 B2 1/2008 Boor et al.
7,369,669 B2 5/2008 Hagen et al.
7,412,294 B1 8/2008 Woolfork
7,433,435 B2 10/2008 Nagaraja
7,447,325 B2 11/2008 Bren et al.
7,450,078 B2 11/2008 Knudsen et al.
7,519,194 B2 4/2009 Niederdrank et al.
7,529,565 B2 5/2009 Hilpisch et al.
7,561,707 B2 7/2009 Kornagel
7,590,253 B2 9/2009 Killion
7,596,237 B1 9/2009 Constantin
7,702,121 B2 4/2010 Husung et al.
7,778,432 B2 8/2010 Larsen
7,791,551 B2 9/2010 Platz
7,813,762 B2 10/2010 Sanguino et al.
7,822,217 B2 10/2010 Hagen et al.
8,041,062 B2 10/2011 Cohen et al.
8,041,066 B2 10/2011 Solum
8,169,938 B2 5/2012 Duchscher et al.
8,194,901 B2 6/2012 Alber et al.
8,208,642 B2 * 6/2012 Edwards ..... H04R 25/554 381/23.1
8,224,004 B2 7/2012 Baechler et al.
8,254,608 B2 8/2012 De Finis
8,280,086 B2 10/2012 Topholm
8,331,592 B2 12/2012 Wu et al.
8,340,331 B2 12/2012 Pansell et al.
8,380,320 B2 2/2013 Spital
8,515,114 B2 8/2013 Solum
8,548,180 B2 10/2013 Takagi et al.
8,559,663 B1 10/2013 Sacha et al.
8,588,443 B2 11/2013 Glatt et al.
8,712,083 B2 4/2014 Solum
8,737,653 B2 5/2014 Woods
8,804,988 B2 8/2014 Solum et al.
8,811,639 B2 8/2014 Solum et al.
8,891,793 B1 11/2014 Sacha et al.
9,036,823 B2 * 5/2015 Edwards ..... H04R 25/554 381/23.1
9,204,227 B2 12/2015 Woods
9,282,416 B2 3/2016 Solum
9,402,142 B2 7/2016 Solum et al.
9,420,385 B2 8/2016 Solum et al.
9,420,387 B2 8/2016 Solum et al.
9,426,586 B2 8/2016 Solum et al.
9,510,111 B2 * 11/2016 Edwards ..... H04S 1/005
9,635,470 B2 4/2017 Solum
9,774,961 B2 9/2017 Solum et al.
9,854,369 B2 12/2017 Solum
10,051,385 B2 * 8/2018 Edwards ..... H04S 1/005
10,469,960 B2 * 11/2019 Edwards ..... H04R 25/552
10,511,918 B2 12/2019 Solum
2001/0007050 A1 7/2001 Adelman
2001/0007335 A1 7/2001 Tuttle et al.
2002/0006206 A1 1/2002 Scofield
2002/0030871 A1 3/2002 Anderson et al.
2002/0076073 A1 6/2002 Taenzer et al.
2002/0090099 A1 7/2002 Hwang
2002/0131614 A1 9/2002 Jakob et al.
2002/0132585 A1 9/2002 Palermo et al.
2002/0174340 A1 11/2002 Dick et al.
2002/0186857 A1 12/2002 Bren et al.
2003/0045283 A1 3/2003 Hagedoorn
2003/0059073 A1 3/2003 Bren et al.
2003/0059076 A1 3/2003 Martin
2003/0076974 A1 4/2003 Barthel et al.
2003/0078071 A1 4/2003 Uchiyama
2003/0083058 A1 5/2003 Mayer
2003/0133582 A1 7/2003 Niederdrank
2003/0149526 A1 8/2003 Zhou et al.
2003/0215106 A1 11/2003 Hagen et al.
2003/0231783 A1 12/2003 Kah
2004/0010181 A1 1/2004 Feeley et al.
2004/0037442 A1 2/2004 Nielsen et al.
2004/0052391 A1 3/2004 Bren et al.
2004/0052392 A1 3/2004 Sacha et al.
2004/0077387 A1 4/2004 Sayag et al.
2004/0136555 A1 7/2004 Enzmann
2004/0141628 A1 7/2004 Villaverde et al.
2004/0190739 A1 9/2004 Bachler et al.
2004/0193090 A1 9/2004 Lebel et al.
2004/0208333 A1 10/2004 Cheung et al.
2004/0234090 A1 11/2004 Berg
2004/0259585 A1 12/2004 Yitzchak et al.
2005/0008178 A1 1/2005 Joergensen et al.
2005/0058313 A1 3/2005 Victorian et al.
2005/0078844 A1 4/2005 Von
2005/0099341 A1 5/2005 Zhang et al.
2005/0100182 A1 5/2005 Sykes et al.
2005/0111401 A1 5/2005 Terry
2005/0111682 A1 5/2005 Essabar et al.
2005/0160270 A1 7/2005 Goldberg et al.
2005/0197061 A1 9/2005 Hundal
2005/0244024 A1 11/2005 Fischer et al.
2005/0249371 A1 11/2005 Vogt
2005/0283263 A1 12/2005 Eaton et al.
2006/0013420 A1 1/2006 Sacha
2006/0018497 A1 1/2006 Kornagel
2006/0039577 A1 2/2006 Sanguino et al.
2006/0044140 A1 3/2006 Berg
2006/0057973 A1 3/2006 Wikel et al.
2006/0067549 A1 3/2006 Puder et al.
2006/0067550 A1 3/2006 Puder et al.
2006/0068842 A1 3/2006 Sanguino et al.
2006/0093172 A1 5/2006 Ludvigsen et al.
2006/0193273 A1 8/2006 Passier et al.
2006/0193375 A1 8/2006 Lee
2006/0198529 A1 9/2006 Kjems et al.
2006/0205349 A1 9/2006 Passier et al.
2006/0245611 A1 11/2006 Jorgensen et al.
2006/0274747 A1 12/2006 Duchscher et al.
2007/0004464 A1 1/2007 Lair et al.
2007/0009123 A1 1/2007 Aschoff et al.
2007/0009124 A1 1/2007 Larsen
2007/0066297 A1 3/2007 Heidari-Bateni
2007/0080889 A1 4/2007 Zhang
2007/0116308 A1 5/2007 Zurek et al.
2007/0121975 A1 5/2007 Sacha et al.
2007/0149261 A1 6/2007 Huddart
2007/0230727 A1 10/2007 Sanguino et al.
2007/0248237 A1 10/2007 Bren et al.
2007/0269065 A1 11/2007 Kilsgaard
2007/0274550 A1 11/2007 Baechler et al.
2008/0008341 A1 1/2008 Edwards
2008/0013769 A1 1/2008 Sacha et al.
2008/0158432 A1 7/2008 Hwang et al.

(56) References Cited

U.S. PATENT DOCUMENTS

| | | | |
|---|---|---|---|
| 2008/0159548 | A1 | 7/2008 | Solum |
| 2008/0165829 | A1 | 7/2008 | Lee et al. |
| 2008/0175421 | A1 | 7/2008 | Chizari |
| 2008/0186241 | A1 | 8/2008 | Christensen |
| 2008/0205664 | A1 | 8/2008 | Kim et al. |
| 2008/0232623 | A1 | 9/2008 | Solum et al. |
| 2008/0260180 | A1 | 10/2008 | Goldstien et al. |
| 2008/0272980 | A1 | 11/2008 | Adel et al. |
| 2008/0273727 | A1 | 11/2008 | Hagen et al. |
| 2008/0306745 | A1 | 12/2008 | Roy et al. |
| 2009/0010464 | A1 | 1/2009 | Kornagel |
| 2009/0058635 | A1 | 3/2009 | LaLonde et al. |
| 2009/0173443 | A1 | 7/2009 | Kozlak et al. |
| 2010/0148931 | A1 | 6/2010 | Pappu et al. |
| 2010/0195836 | A1 | 8/2010 | Platz |
| 2010/0208631 | A1 | 8/2010 | Zhang et al. |
| 2010/0239111 | A1 | 9/2010 | Karamuk et al. |
| 2010/0246865 | A1 | 9/2010 | Suurballe |
| 2010/0246866 | A1 | 9/2010 | Swain et al. |
| 2010/0303268 | A1 | 12/2010 | Frerking et al. |
| 2010/0304065 | A1 | 12/2010 | Tomantschger et al. |
| 2010/0321269 | A1 | 12/2010 | Ishibana et al. |
| 2011/0019830 | A1 | 1/2011 | Leibman et al. |
| 2011/0032071 | A1 | 2/2011 | Tondering |
| 2011/0051965 | A1 | 3/2011 | Beck et al. |
| 2011/0090837 | A1 | 4/2011 | Duchscher et al. |
| 2011/0150251 | A1 | 6/2011 | Solum et al. |
| 2011/0150252 | A1 | 6/2011 | Solum et al. |
| 2011/0150254 | A1 | 6/2011 | Solum et al. |
| 2011/0150255 | A1 | 6/2011 | Solum |
| 2011/0158442 | A1 | 6/2011 | Woods |
| 2011/0249836 | A1 | 10/2011 | Solum et al. |
| 2011/0249837 | A1 | 10/2011 | Galster et al. |
| 2011/0249842 | A1 | 10/2011 | Solum et al. |
| 2012/0093324 | A1 | 4/2012 | Ozden |
| 2012/0121094 | A1 | 5/2012 | Solum |
| 2012/0163644 | A1 | 6/2012 | Xu et al. |
| 2012/0177235 | A1 | 7/2012 | Solum |
| 2012/0209101 | A1 | 8/2012 | Kidmose et al. |
| 2012/0308019 | A1 | 12/2012 | Edwards |
| 2012/0310395 | A1 | 12/2012 | El-Hoiydi |
| 2013/0004002 | A1 | 1/2013 | Duchscher et al. |
| 2013/0017786 | A1 | 1/2013 | Kvist et al. |
| 2013/0114579 | A1 | 5/2013 | Vujcic |
| 2013/0308805 | A1 | 11/2013 | Ozden |
| 2013/0322493 | A1 | 12/2013 | Jersenius et al. |
| 2014/0023216 | A1 | 1/2014 | Solum et al. |
| 2014/0177885 | A1 | 6/2014 | Solum |
| 2014/0198937 | A1 | 7/2014 | Sacha et al. |
| 2014/0348359 | A1 | 11/2014 | Woods |
| 2015/0023513 | A1 | 1/2015 | Solum |
| 2015/0023539 | A1 | 1/2015 | Bauman |
| 2015/0036855 | A1 | 2/2015 | Solum et al. |
| 2015/0071469 | A1 | 3/2015 | Solum et al. |
| 2015/0172835 | A1 | 6/2015 | Sacha et al. |
| 2015/0256951 | A1 | 9/2015 | Edwards |
| 2016/0044426 | A1 | 2/2016 | Duchscher et al. |
| 2016/0080956 | A1 | 3/2016 | Hoole |
| 2016/0234612 | A1 | 8/2016 | Solum et al. |
| 2016/0323677 | A1 | 11/2016 | Solum |
| 2017/0041896 | A1 | 2/2017 | Solum et al. |
| 2017/0142528 | A1 | 5/2017 | Edwards |
| 2017/0238103 | A1 | 8/2017 | Gehring et al. |
| 2018/0014131 | A1 | 1/2018 | Solum et al. |
| 2018/0206048 | A1 | 7/2018 | Solum |
| 2018/0343527 | A1 | 11/2018 | Edwards |

FOREIGN PATENT DOCUMENTS

| | | | |
|---|---|---|---|
| CN | 1191060 | A | 8/1998 |
| CN | 101233786 | B | 5/2013 |
| DE | 2510731 | A1 | 9/1976 |
| DE | 3036417 | A1 | 5/1982 |
| DE | 3443907 | A1 | 6/1985 |
| DE | 10146886 | A1 | 4/2003 |
| EP | 0789474 | A2 | 8/1997 |
| EP | 0941014 | A2 | 9/1999 |
| EP | 0989775 | A1 | 3/2000 |
| EP | 1185138 | A2 | 3/2002 |
| EP | 1196008 | A2 | 4/2002 |
| EP | 1365628 | A2 | 11/2003 |
| EP | 1398995 | A2 | 3/2004 |
| EP | 1174003 | B1 | 7/2004 |
| EP | 1445982 | A1 | 8/2004 |
| EP | 1484942 | A2 | 12/2004 |
| EP | 1519625 | A2 | 3/2005 |
| EP | 1531650 | A | 5/2005 |
| EP | 1531650 | A2 | 5/2005 |
| EP | 1643801 | A2 | 4/2006 |
| EP | 1670283 | A1 | 6/2006 |
| EP | 1681903 | A2 | 7/2006 |
| EP | 1715718 | A2 | 10/2006 |
| EP | 1953934 | A1 | 8/2008 |
| EP | 1980132 | B1 | 10/2008 |
| EP | 2012557 | A2 | 1/2009 |
| EP | 2052758 | A1 | 4/2009 |
| EP | 1365628 | B1 | 12/2011 |
| EP | 2403273 | A1 | 1/2012 |
| EP | 2613566 | A1 | 7/2013 |
| EP | 1879426 | B1 | 8/2013 |
| EP | 2765650 | A1 | 8/2014 |
| EP | 2582158 | B1 | 8/2016 |
| FR | 2714561 | A1 | 6/1995 |
| JP | 918998 | A | 1/1997 |
| JP | 10084209 | | 3/1998 |
| JP | 201490467 | A | 5/2014 |
| KR | 101253799 | B1 | 4/2013 |
| WO | WO-9641498 | A1 | 12/1996 |
| WO | WO-1996041498 | A1 | 12/1996 |
| WO | WO-9848526 | A2 | 10/1998 |
| WO | WO-0021332 | A2 | 4/2000 |
| WO | WO-0022874 | A2 | 4/2000 |
| WO | WO-0158064 | A1 | 8/2001 |
| WO | WO-0167433 | A1 | 9/2001 |
| WO | WO-0203750 | A2 | 1/2002 |
| WO | WO-0209363 | A2 | 1/2002 |
| WO | WO-2002009363 | A2 | 1/2002 |
| WO | WO-0223950 | A2 | 3/2002 |
| WO | WO-02061957 | A2 | 8/2002 |
| WO | WO-03008013 | A2 | 1/2003 |
| WO | WO-04034738 | A1 | 4/2004 |
| WO | WO-2004100607 | A1 | 11/2004 |
| WO | WO-2004110099 | A | 12/2004 |
| WO | WO-2004110099 | A2 | 12/2004 |
| WO | WO-2005009072 | A2 | 1/2005 |
| WO | WO-2005061048 | A1 | 7/2005 |
| WO | WO-2005101731 | A2 | 10/2005 |
| WO | WO-2006023857 | A1 | 3/2006 |
| WO | WO-2006023920 | A1 | 3/2006 |
| WO | WO-2006074655 | A1 | 7/2006 |
| WO | WO-2006078586 | A2 | 7/2006 |
| WO | WO-2006133158 | A1 | 12/2006 |
| WO | WO-2007068243 | A1 | 6/2007 |
| WO | WO-2008151624 | A1 | 12/2008 |
| WO | WO-2009063097 | A2 | 5/2009 |
| WO | WO-2009076949 | A1 | 6/2009 |
| WO | WO-2010033731 | A1 | 3/2010 |
| WO | WO-2012092973 | A1 | 7/2012 |
| WO | WO-2014184394 | A2 | 11/2014 |
| WO | WO-2014198323 | A1 | 12/2014 |
| WO | WO-2016130593 | A1 | 8/2016 |

OTHER PUBLICATIONS

"3D Circuits-A-Laser", [Online]. Retrieved from the Internet: <http://www.a-laser.com/3dcircuits.html>, (2012).

"U.S. Appl. No. 09/052,631, Final Office Action dated Jul. 11, 2000", 8 pgs.

"U.S. Appl. No. 09/052,631, Final Office Action dated Jul. 30, 2001", 5 pgs.

"U.S. Appl. No. 09/052,631, Non Final Office Action dated Jan. 18, 2001", 6 pgs.

(56) References Cited

OTHER PUBLICATIONS

"U.S. Appl. No. 09/052,631, Non Final Office Action dated Dec. 28, 1999", 10 pgs.
"U.S. Appl. No. 09/052,631, Notice of Allowance dated Dec. 18, 2001", 6 pgs.
"U.S. Appl. No. 09/052,631, Response filed May 18, 2001 to Non Final Office Action dated Jan. 18, 2001", 7 pgs.
"U.S. Appl. No. 09/052,631, Response filed Oct. 30, 2001 to Final Office Action dated Jul. 30, 2001", 5 pgs.
"U.S. Appl. No. 09/052,631, Response filed Nov. 10, 2000 to Final Office Action dated Jul. 11, 2000", 5 pgs.
"U.S. Appl. No. 09/659,214, Advisory Action dated Jun. 2, 2003", 3 pgs.
"U.S. Appl. No. 09/659,214, Final Office Action dated Feb. 14, 2003", 7 pgs.
"U.S. Appl. No. 09/659,214, Final Office Action dated Mar. 19, 2003", 7 pgs.
"U.S. Appl. No. 09/659,214, Non Final Office Action dated Jul. 18, 2003", 7 pgs.
"U.S. Appl. No. 09/659,214, Non Final Office Action dated Sep. 6, 2002", 7 pgs.
"U.S. Appl. No. 09/659,214, Notice of Allowance dated Feb. 10, 2004", 6 pgs.
"U.S. Appl. No. 09/659,214, Response filed May 19, 2003 to Final Office Action dated Mar. 19, 2003", 9 pgs.
"U.S. Appl. No. 09/659,214, Response filed Oct. 24, 2003 to Non Final Office Action dated Jul. 18, 2003", 9 pgs.
"U.S. Appl. No. 09/659,214, Response filed Nov. 12, 2002 to Non Final Office Action dated Sep. 6, 2002", 10 pgs.
"U.S. Appl. No. 10/146,536, Advisory Action dated Oct. 16, 2007", 5 pgs.
"U.S. Appl. No. 10/146,536, Final Office Action dated May 18, 2007", 28 pgs.
"U.S. Appl. No. 10/146,536, Non-Final Office Action dated Sep. 19, 2006", 26 pgs.
"U.S. Appl. No. 10/146,536, Non-Final Office Action dated Dec. 16, 2005", 25 pgs.
"U.S. Appl. No. 10/146,536, Notice of Allowance dated Dec. 27, 2007", 10 pgs.
"U.S. Appl. No. 10/146,536, Response filed Feb. 20, 2007 to Non-Final Office Action dated Sep. 19, 2006", 20 pgs.
"U.S. Appl. No. 10/146,536, Response filed Jun. 16, 2006 to Non-Final Office Action dated Dec. 16, 2005", 14 pgs.
"U.S. Appl. No. 10/146,536, Response filed Nov. 19, 2007 to Final Office Action dated May 18, 2007", 19 pgs.
"U.S. Appl. No. 10/146,536, Response filed Sep. 18, 2007 to Final Office Action dated Jun. 18, 2007", 24 pgs.
"U.S. Appl. No. 10/214,045, 312 Amendment filed Jun. 12, 2003", 6 pgs.
"U.S. Appl. No. 10/214,045, Non Final Office Action dated Dec. 2, 2002", 7 pgs.
"U.S. Appl. No. 10/214,045, Notice of Allowance dated Apr. 8, 2003", 17 pgs.
"U.S. Appl. No. 10/214,045, Response filed Apr. 2, 2003 to Non Final Office Action dated Dec. 2, 2002", 8 pgs.
"U.S. Appl. No. 10/243,412, Examiner Interview Summary dated Mar. 9, 2006", 7 pgs.
"U.S. Appl. No. 10/243,412, Final Office Action dated Jan. 9, 2008", 6 pgs.
"U.S. Appl. No. 10/243,412, Non Final Office Action dated May 17, 2007", 10 pgs.
"U.S. Appl. No. 10/243,412, Non Final Office Action dated Jul. 28, 2006", 10 pgs.
"U.S. Appl. No. 10/243,412, Notice of Allowance dated Jun. 30, 2008", 8 pgs.
"U.S. Appl. No. 10/243,412, Response filed Jan. 16, 2006 to Restriction Requirement dated Dec. 16, 2005", 12 pgs.
"U.S. Appl. No. 10/243,412, Response filed May 9, 2008 to Non-Final Office Action dated Jan. 9, 2008", 12 pgs.
"U.S. Appl. No. 10/243,412, Response filed Sep. 17, 2007 to Non Final Office Action dated May 17, 2007", 15 pgs.
"U.S. Appl. No. 10/243,412, Response filed Dec. 28, 2006 to Non Final Office Action dated Jul. 28, 2006", 16 pgs.
"U.S. Appl. No. 10/243,412, Restriction Requirement dated Dec. 16, 2005", 5 pgs.
"U.S. Appl. No. 10/244,295, Final Office Action dated May 24, 2007", 11 pgs.
"U.S. Appl. No. 10/244,295, Final Office Action dated Aug. 11, 2006", 9 pgs.
"U.S. Appl. No. 10/244,295, Non Final Office Action dated Feb. 3, 2006", 9 pgs.
"U.S. Appl. No. 10/244,295, Non Final Office Action dated Mar. 11, 2005", 10 pgs.
"U.S. Appl. No. 10/244,295, Non Final Office Action dated Nov. 29, 2006", 12 pgs.
"U.S. Appl. No. 10/244,295, Notice of Allowance dated Aug. 7, 2007", 7 pgs.
"U.S. Appl. No. 10/244,295, Response filed Feb. 28, 2007 to Non Final Office Action dated Nov. 29, 2006", 16 pgs.
"U.S. Appl. No. 10/244,295, Response filed May 3, 2020 to Non-Final Office Action dated Feb. 3, 2006", 17 pgs.
"U.S. Appl. No. 10/244,295, Response filed Jun. 13, 2005 to Non-Final Office Action dated Mar. 11, 2005", 20 pgs.
"U.S. Appl. No. 10/244,295, Response filed Jul. 24, 2007 to Final Office Action dated May 24, 2007", 12 pgs.
"U.S. Appl. No. 10/244,295, Response filed Oct. 11, 2006 to Final Office Action dated Aug. 11, 2006", 17 pgs.
"U.S. Appl. No. 10/284,877, Final Office Action dated Jun. 14, 2006", 11 pgs.
"U.S. Appl. No. 10/284,877, Final Office Action dated Nov. 14, 2006", 11 pgs.
"U.S. Appl. No. 10/284,877, Non Final Office Action dated Mar. 25, 2005", 8 pgs.
"U.S. Appl. No. 10/284,877, Non Final Office Action dated Dec. 1, 2005", 10 pgs.
"U.S. Appl. No. 10/284,877, Notice of Allowance dated Mar. 22, 2007", 7 pgs.
"U.S. Appl. No. 10/284,877, Response filed Mar. 1, 2006 to Non Final Office Action dated Dec. 1, 2005", 17 pgs.
"U.S. Appl. No. 10/284,877, Response filed Mar. 14, 2007 to Final Office Action dated Nov. 14, 2006", 8 pgs.
"U.S. Appl. No. 10/284,877, Response filed Jun. 27, 2005 to Non Final Office Action dated Mar. 25, 2005", 15 pgs.
"U.S. Appl. No. 10/284,877, Response filed Oct. 16, 2006 to Final Office Action dated Jun. 14, 2006", 16 pgs.
"U.S. Appl. No. 11/207,555, Final Office Action dated Jan. 22, 2009", 15 pgs.
"U.S. Appl. No. 11/207,555, Final Office Action dated Feb. 4, 2010", 13 pgs.
"U.S. Appl. No. 11/207,555, Non-Final Office Action dated Jun. 3, 2008", 12 pgs.
"U.S. Appl. No. 11/207,555, Non-Final Office Action dated Jul. 16, 2009", 12 pgs.
"U.S. Appl. No. 11/207,555, Response filed Jun. 22, 2009 to Final Office Action dated Jan. 22, 2009", 9 pgs.
"U.S. Appl. No. 11/207,555, Response filed Nov. 3, 2008 to Non Final Office Action dated Jun. 3, 2008", 8 pgs.
"U.S. Appl. No. 11/207,555, Response filed Nov. 16, 2009 to Non-Final Office Action dated Jul. 15, 2009", 8 pgs.
"U.S. Appl. No. 11/207,591, Final Office Action dated Jan. 6, 2009", 13 pgs.
"U.S. Appl. No. 11/207,591, Final Office Action dated Jan. 15, 2010", 13 pgs.
"U.S. Appl. No. 11/207,591, Non-Final Office Action dated Jul. 14, 2009", 13 pgs.
"U.S. Appl. No. 11/207,591, Non-Final Office Action dated Jul. 28, 2008", 11 pgs.
"U.S. Appl. No. 11/207,591, Non-Final Office Action dated Nov. 16, 2007", 9 pgs.
"U.S. Appl. No. 11/207,591, Response filed May 6, 2008 to Non Final Office Action dated Nov. 16, 2007", 8 pgs.

(56) References Cited

OTHER PUBLICATIONS

"U.S. Appl. No. 11/207,591, Response filed May 6, 2009 to Final Office Action dated Jan. 6, 2009", 8 pgs.
"U.S. Appl. No. 11/207,591, Response filed Oct. 14, 2009 to Non Final Office Action dated Jul. 14, 2009", 10 pgs.
"U.S. Appl. No. 11/207,591, Response filed Oct. 28, 2008 to Non Final Office Action dated Jul. 28, 2008", 7 pgs.
"U.S. Appl. No. 11/207,591, Notice of Allowance dated Jul. 1, 2010", 7 pgs.
"U.S. Appl. No. 11/207,591, Response filed Jun. 15, 2010 to Final Office Action dated Jan. 15, 2010", 9 pgs.
"U.S. Appl. No. 11/447,617, Final Office Action dated Mar. 3, 2010", 31 pgs.
"U.S. Appl. No. 11/447,617, Non Final Office Action dated Aug. 31, 2011", 29 pgs.
"U.S. Appl. No. 11/447,617, Non-Final Office Action dated Jun. 22, 2009", 25 pgs.
"U.S. Appl. No. 11/447,617, Notice of Allowance dated Mar. 16, 2012", 8 pgs.
"U.S. Appl. No. 11/447,617, Response filed Feb. 29, 2012 to Non Final Office Action dated Aug. 31, 2011", 13 pgs.
"U.S. Appl. No. 11/447,617, Response filed May 26, 2009 to Restriction Requirement dated Apr. 24, 2009", 8 pgs.
"U.S. Appl. No. 11/447,617, Response filed Aug. 3, 2010 to Final Office Action dated Mar. 3, 2010", 14 pgs.
"U.S. Appl. No. 11/447,617, Response filed Nov. 23, 2009 to Non Final Office Action dated Jun. 22, 2009", 15 pgs.
"U.S. Appl. No. 11/447,617, Restriction Requirement dated Apr. 24, 2009", 6 pgs.
"U.S. Appl. No. 11/456,538, Final Office Action dated Mar. 3, 2011", 28 pgs.
"U.S. Appl. No. 11/456,538, Non-Final Office Action dated Aug. 19, 2010", 25 Pgs.
"U.S. Appl. No. 11/456,538, Notice of Allowance dated Apr. 5, 2012", 10 pgs.
"U.S. Appl. No. 11/456,538, Notice of Allowance dated May 16, 2012", 10 pgs.
"U.S. Appl. No. 11/456,538, Notice of Allowance dated Dec. 19, 2011", 9 pgs.
"U.S. Appl. No. 11/456,538, Response filed Jan. 19, 2011 to Non Final Office Action dated Aug. 19, 2010", 16 pgs.
"U.S. Appl. No. 11/456,538, Response filed Aug. 5, 2011 to Final Office Action dated Mar. 3, 2011", 15 pgs.
"U.S. Appl. No. 11/619,541, Non Final Office Action dated Dec. 21, 2010", 7 pgs.
"U.S. Appl. No. 11/619,541, Notice of Allowance dated Jul. 5, 2011", 6 pgs.
"U.S. Appl. No. 11/619,541, Response filed May 23, 2011 to Non Final Office Action dated Dec. 21, 2010", 10 pgs.
"U.S. Appl. No. 11/692,763, Non-Final Office Action dated Jan. 21, 2010", 11 pgs.
"U.S. Appl. No. 11/692,763, Response filed Jun. 21, 2010 to Non Final Office Action dated Jan. 21, 2010", 9 pgs.
"U.S. Appl. No. 12/115,423, Notice of Allowance dated Sep. 15, 2010", 9 pgs.
"U.S. Appl. No. 12/643,540, Advisory Action dated Sep. 25, 2014", 4 pgs.
"U.S. Appl. No. 12/643,540, Advisory Action dated Sep. 26, 2013", 2 pgs.
"U.S. Appl. No. 12/643,540, Corrected Notice of Allowance dated May 6, 2016", 2 pgs.
"U.S. Appl. No. 12/643,540, Final Office Action dated Jun. 5, 2014", 17 pgs.
"U.S. Appl. No. 12/643,540, Final Office Action dated Jun. 7, 2013", 13 pgs.
"U.S. Appl. No. 12/643,540, Final Office Action dated Jul. 2, 2015", 22 pgs.
"U.S. Appl. No. 12/643,540, Non Final Office Action dated Aug. 16, 2012", 14 pgs.
"U.S. Appl. No. 12/643,540, Non Final Office Action dated Dec. 19, 2014", 17 pgs.
"U.S. Appl. No. 12/643,540, Non Final Office Action dated Dec. 30, 2013", 15 pgs.
"U.S. Appl. No. 12/643,540, Notice of Allowance dated Apr. 15, 2016", 10 pgs.
"U.S. Appl. No. 12/643,540, Response filed Jan. 16, 2013 to Non Final Office Action dated Aug. 16, 2012", 8 pgs.
"U.S. Appl. No. 12/643,540, Response filed Mar. 31, 2014 to Non Final Office Action dated Dec. 30, 2013", 7 pgs.
"U.S. Appl. No. 12/643,540, Response filed Apr. 20, 2015 to Non Final Office Action dated Dec. 19, 2014", 8 pgs.
"U.S. Appl. No. 12/643,540, Response filed Sep. 5, 2014 to Final Office Action dated Jun. 5, 2014", 8 pgs.
"U.S. Appl. No. 12/643,540, Response filed Sep. 6, 2013 to Final Officer Action dated Jun. 7, 2013", 7 pgs.
"U.S. Appl. No. 12/643,540, Response filed Dec. 2, 2015 to Final Office Action dated Jul. 2, 2015", 7 pgs.
"U.S. Appl. No. 12/649,648 , Response filed Jun. 5, 2013 to Non Final Office Action dated Mar. 5, 2013", 9 pgs.
"U.S. Appl. No. 12/649,648 , Response filed Nov. 13, 2013 to Final Office Action dated Sep. 13, 2013", 9 pgs.
"U.S. Appl. No. 12/649,648, Final Office Action dated Sep. 13, 2013", 16 pgs.
"U.S. Appl. No. 12/649,648, Non Final Office Action dated Mar. 5, 2013", 15 pgs.
"U.S. Appl. No. 12/649,648, Notice of Allowance dated Nov. 22, 2013", 7 pgs.
"U.S. Appl. No. 12/776,038, Non Final Office Action dated Sep. 27, 2012", 9 pgs.
"U.S. Appl. No. 12/776,038, Notice of Allowance dated Jan. 18, 2013", 9 pgs.
"U.S. Appl. No. 12/776,038, Notice of Allowance dated Jun. 10, 2013", 9 pgs.
"U.S. Appl. No. 12/776,038, Response filed Dec. 26, 2012 to Non Final Office Action dated Sep. 27, 2012", 7 pgs.
"U.S. Appl. No. 12/823,505 , Response filed Feb. 4, 2014 to Non Final Office Action dated Nov. 4, 2014", 8 pgs.
"U.S. Appl. No. 12/823,505 , Response filed Apr. 23, 2013 to Non Final Office Action dated Jan. 23, 2013", 12 pgs.
"U.S. Appl. No. 12/823,505, Advisory Action dated Oct. 4, 2013", 3 pgs.
"U.S. Appl. No. 12/823,505, Final Office Action dated Apr. 29, 2014", 11 pgs.
"U.S. Appl. No. 12/823,505, Final Office Action dated Jul. 18, 2013", 9 pgs.
"U.S. Appl. No. 12/823,505, Non Final Office Action dated Jan. 23, 2013", 11 pgs.
"U.S. Appl. No. 12/823,505, Non Final Office Action dated Nov. 4, 2013", 9 pgs.
"U.S. Appl. No. 12/823,505, Notice of Allowance dated Jul. 18, 2014", 9 pgs.
"U.S. Appl. No. 12/823,505, Response filed Jun. 30, 2014 to Final Office Action dated Apr. 29, 2014", 8 pgs.
"U.S. Appl. No. 12/823,505, Response filed Sep. 4, 2013 to Restriction Requirement dated Aug. 2, 2013", 6 pgs.
"U.S. Appl. No. 12/823,505, Response filed Sep. 18, 2013 to Final Office Action dated Jul. 18, 2013", 8 pgs.
"U.S. Appl. No. 12/823,505, Response filed Dec. 19, 2012 to Restriction Requirement dated Oct. 19, 2012", 6 pgs.
"U.S. Appl. No. 12/823,505, Restriction Requirement dated Aug. 2, 2012", 6 pgs.
"U.S. Appl. No. 12/823,505, Restriction Requirement dated Oct. 19, 2012", 6 pgs.
"U.S. Appl. No. 12/830,892, Advisory Action dated Sep. 15, 2014", 4 pgs.
"U.S. Appl. No. 12/830,892, Final Office Action dated Apr. 1, 2013", 16 pgs.
"U.S. Appl. No. 12/830,892, Final Office Action dated Jun. 13, 2014", 17 pgs.
"U.S. Appl. No. 12/830,892, Final Office Action dated Jul. 6, 2015", 23 pgs.

(56) References Cited

OTHER PUBLICATIONS

"U.S. Appl. No. 12/830,892, Non Final Office Action dated Jan. 19, 2015", 19 pgs.
"U.S. Appl. No. 12/830,892, Non Final Office Action dated Aug. 17, 2012", 15 pgs.
"U.S. Appl. No. 12/830,892, Non Final Office Action dated Dec. 20, 2013", 15 pgs.
"U.S. Appl. No. 12/830,892, Notice of Allowance dated Apr. 8, 2016", 10 pgs.
"U.S. Appl. No. 12/830,892, Response filed Jan. 16, 2013 to Non Final Office Action dated Aug. 17, 2012", 8 pgs.
"U.S. Appl. No. 12/830,892, Response filed Mar. 20, 2014 to Non Final Office Action dated Dec. 20, 2013", 7 pgs.
"U.S. Appl. No. 12/830,892, Response filed Apr. 29, 2015 to Non Final Office Action dated Jan. 29, 2015", 8 pgs.
"U.S. Appl. No. 12/830,892, Response filed Jul. 1, 2013 to Final Office Action dated Apr. 1, 2013", 9 pgs.
"U.S. Appl. No. 12/830,892, Response filed Aug. 13, 2014 to Final Office Action dated Jun. 13, 2014", 8 pgs.
"U.S. Appl. No. 12/830,892, Response filed Nov. 6, 2015 to Final Office Action dated Jul. 6, 2015", 7 pgs.
"U.S. Appl. No. 12/980,696, Non Final Office Action dated Apr. 20, 2011", 7 pgs.
"U.S. Appl. No. 12/981,035, Advisory Action dated Jul. 11, 2013", 3 pgs.
"U.S. Appl. No. 12/981,035, Final Office Action dated Jan. 15, 2014", 17 pgs.
"U.S. Appl. No. 12/981,035, Final Office Action dated Aug. 8, 2013", 17 pgs.
"U.S. Appl. No. 12/981,035, Non Final Office Action dated Aug. 29, 2013", 17 pgs.
"U.S. Appl. No. 12/981,035, Non Final Office Action dated Nov. 20, 2012", 16 pgs.
"U.S. Appl. No. 12/981,035, Notice of Allowance dated Apr. 1, 2014", 9 pgs.
"U.S. Appl. No. 12/981,035, Response filed Feb. 20, 2013 to Non Final Office Action dated Nov. 30, 2012", 7 pgs.
"U.S. Appl. No. 12/981,035, Response filed Mar. 17, 2014 to Final Office Action dated Jan. 15, 2014", 8 pgs.
"U.S. Appl. No. 12/981,035, Response filed Jun. 10, 2013 to Final Office Action dated Apr. 8, 2013", 7 pgs.
"U.S. Appl. No. 12/981,035, Response filed Nov. 27, 2013 to Non Final Office Action dated Aug. 29, 2013", 7 pgs.
"U.S. Appl. No. 12/981,108, Advisory Action dated Jun. 4, 2015", 6 pgs.
"U.S. Appl. No. 12/981,108, Advisory Action dated Oct. 1, 2013", 3 pgs.
"U.S. Appl. No. 12/981,108, Corrected Notice of Allowance dated May 6, 2016", 2 pgs.
"U.S. Appl. No. 12/981,108, Final Office Action dated Jun. 6, 2013", 11 pgs.
"U.S. Appl. No. 12/981,108, Final Office Action dated Dec. 19, 2014", 17 pgs.
"U.S. Appl. No. 12/981,108, Non Final Office Action dated Apr. 3, 2014", 13 pgs.
"U.S. Appl. No. 12/981,108, Non Final Office Action dated Jul. 6, 2015", 23 pgs.
"U.S. Appl. No. 12/981,108, Non Final Office Action dated Aug. 17, 2012", 10 pgs.
"U.S. Appl. No. 12/981,108, Notice of Allowance dated Apr. 14, 2016", 11 pgs.
"U.S. Appl. No. 12/981,108, Response filed Jan. 16, 2013 to Non Final Office Action dated Aug. 17, 2012", 8 pgs.
"U.S. Appl. No. 12/981,108, Response filed Apr. 20, 2015 to Final Offfice Aciton dated Dec. 19, 2014", 8 pgs.
"U.S. Appl. No. 12/981,108, Response filed Jun. 19, 2015 to Advisory Action dated Jun. 4, 2015", 8 pgs.
"U.S. Appl. No. 12/981,108, Response filed Aug. 13, 2014 to Non Final Office Action dated Apr. 3, 2014", 7 pgs.
"U.S. Appl. No. 12/981,108, Response filed Sep. 6, 2013 to Final Office Action dated Jun. 6, 2013", 7 pgs.
"U.S. Appl. No. 12/981,108, Response filed Dec. 4, 2015 to Non Final Office Action dated Jul. 6, 2015", 8 pgs.
"U.S. Appl. No. 13/084,988, Corrected Notice of Allowability dated Jun. 4, 2014", 6 pgs.
"U.S. Appl. No. 13/084,988, Corrected Notice of Allowance dated May 21, 2014", 5 pgs.
"U.S. Appl. No. 13/084,988, Corrected Notice of Allowance dated Jul. 8, 2014", 6 pgs.
"U.S. Appl. No. 13/084,988, Non Final Office Action dated Jan. 17, 2013", 12 pgs.
"U.S. Appl. No. 13/084,988, Non Final Office Action dated Oct. 8, 2013", 11 pgs.
"U.S. Appl. No. 13/084,988, Notice of Allowance dated Apr. 11, 2014", 11 pgs.
"U.S. Appl. No. 13/084,988, Response filed Jan. 8, 2014 to Non Final Office Action dated Oct. 8, 2013", 9 pgs.
"U.S. Appl. No. 13/084,988, Response filed Jun. 17, 2013 to Non Final Office Action dated Jan. 17, 2013", 8 pgs.
"U.S. Appl. No. 13/253,550, Non Final Office Action dated Aug. 8, 2013", 12 pgs.
"U.S. Appl. No. 13/253,550, Notice of Allowance dated Dec. 11, 2013", 11 pgs.
"U.S. Appl. No. 13/253,550, Response filed Nov. 8, 2013 to Non Final Office Action dated Aug. 8, 2013", 7 pgs.
"U.S. Appl. No. 13/270,860, Non Final Office Action dated Dec. 18, 2012", 5 pgs.
"U.S. Appl. No. 13/270,860, Notice of Allowance dated Apr. 17, 2013", 10 pgs.
"U.S. Appl. No. 13/270,860, Preliminary Amendment filed Jan. 27, 2012", 7 pgs.
"U.S. Appl. No. 13/270,860, Response filed Mar. 18, 2013 to Non Final Office Action dated Dec. 18, 2012", 7 pgs.
"U.S. Appl. No. 13/458,304, Non Final Office Action dated Mar. 3, 2015", 9 pgs.
"U.S. Appl. No. 13/458,304, Response filed Jul. 6, 2015 to Non Final Office Action dated Mar. 3, 2015", 7 pgs.
"U.S. Appl. No. 13/464,419, Notice of Allowance dated Jan. 16, 2015", 10 pgs.
"U.S. Appl. No. 13/464,419, Preliminary Amendment filed Apr. 25, 2014", (dated Apr. 25, 2014), 8 pgs.
"U.S. Appl. No. 13/551,215, Advisory Action dated Apr. 10, 2015", 4 pgs.
"U.S. Appl. No. 13/551,215, Advisory Action dated Jul. 20, 2016", 4 pgs.
"U.S. Appl. No. 13/551,215, Examiner Interview Summary dated Jul. 20, 2016", 2 pgs.
"U.S. Appl. No. 13/551,215, Final Office Action dated Feb. 8, 2017", 21 pgs.
"U.S. Appl. No. 13/551,215, Final Office Action dated Apr. 7, 2016", 23 pgs.
"U.S. Appl. No. 13/551,215, Final Office Action dated Dec. 3, 2014", 16 pgs.
"U.S. Appl. No. 13/551,215, Non Final Office Action dated Apr. 24, 2014", 16 pgs.
"U.S. Appl. No. 13/551,215, Non Final Office Action dated Sep. 25, 2015", 23 pgs.
"U.S. Appl. No. 13/551,215, Response filed Feb. 3, 2015 to Final Office Action dated Dec. 3, 2014", 8 pgs.
"U.S. Appl. No. 13/551,215, Response filed Jun. 7, 2016 to Final Office Action dated Apr. 7, 2016", 8 pgs.
"U.S. Appl. No. 13/551,215, Response filed Aug. 8, 2016 to Advisory Action dated Jul. 20, 2016", 8 pgs.
"U.S. Appl. No. 13/551,215, Response filed Aug. 19, 2014 to Non Final Office Action dated Apr. 24, 2014", 9 pgs.
"U.S. Appl. No. 13/551,215, Response filed Dec. 28, 2015 to Non Final Office Action dated Sep. 25, 2015", 8 pgs.
"U.S. Appl. No. 13/946,675, Advisory Action dated May 29, 2015", 5 pgs.
"U.S. Appl. No. 13/946,675, Final Office Action dated Mar. 12, 2015", 21 pgs.

(56) References Cited

OTHER PUBLICATIONS

"U.S. Appl. No. 13/946,675, Non Final Office Action dated Aug. 4, 2015", 24 pgs.
"U.S. Appl. No. 13/946,675, Non Final Office Action dated Nov. 7, 2014", 19 pgs.
"U.S. Appl. No. 13/946,675, Preliminary Amendment filed Jun. 23, 2014", 3 pgs.
"U.S. Appl. No. 13/946,675, Response filed Dec. 9, 2015 to Non Final Office Action dated Nov. 7, 2014", 8 pgs.
"U.S. Appl. No. 13/946,675, Response filed May 12, 2015 to Final Office Action dated Mar. 12, 2015", 8 pgs.
"U.S. Appl. No. 13/946,675, Response filed Jul. 13, 2015 to Final Office Action dated Mar. 12, 2015", 8 pgs.
"U.S. Appl. No. 13/970,368, Non Final Office Action dated Jun. 17, 2015", 6 pgs.
"U.S. Appl. No. 13/970,368, Notice of Allowance dated Oct. 29, 2015", 9 pgs.
"U.S. Appl. No. 13/970,368, Preliminary Amendment dated Mar. 6, 2014", (Mar. 6, 2014), 6 pgs.
"U.S. Appl. No. 13/970,368, Response filed Sep. 16, 2015 to Non Final Office Action dated Jul. 17, 2015", 15 pgs.
"U.S. Appl. No. 14/188,104, Final Office Action dated May 14, 2015", 9 pgs.
"U.S. Appl. No. 14/188,104, Non Final Office Action dated Nov. 10, 2014", 9 pgs.
"U.S. Appl. No. 14/188,104, Notice of Allowance dated Jul. 27, 2015", 6 pgs.
"U.S. Appl. No. 14/188,104, Response filed Feb. 10, 2015 to Non Final Office Action dated Nov. 10, 2014", 6 pgs.
"U.S. Appl. No. 14/188,104, Response filed Jul. 13, 2015 to Final Office Action dated May 14, 2015", 7 pgs.
"U.S. Appl. No. 14/262,983, Advisory Action dated Sep. 30, 2016", 3 pgs.
"U.S. Appl. No. 14/262,983, Examiner Interview Summary dated Dec. 15, 2016", 2 pgs.
"U.S. Appl. No. 14/262,983, Final Office Action dated Jul. 13, 2016", 28 pgs.
"U.S. Appl. No. 14/262,983, Non Final Office Action dated Oct. 2, 2015", 20 pgs.
"U.S. Appl. No. 14/262,983, Notice of Allowance dated Dec. 22, 2016", 11 pgs.
"U.S. Appl. No. 14/262,983, Response filed Jan. 4, 2016 to Non Final Office Action dated Oct. 2, 2015", 8 pgs.
"U.S. Appl. No. 14/262,983, Response filed Sep. 13, 2016 to Final Office Action dated Jul. 13, 2016", 8 pgs.
"U.S. Appl. No. 14/452,625, Advisory Action dated Jul. 12, 2017", 3 pgs.
"U.S. Appl. No. 14/452,625, Advisory Action dated Sep. 15, 2016", 4 pgs.
"U.S. Appl. No. 14/452,625, Advisory Action dated Nov. 30, 2015", 4 pgs.
"U.S. Appl. No. 14/452,625, Examiner Interview Summary dated Sep. 15, 2016", 1 pg.
"U.S. Appl. No. 14/452,625, Final Office Action dated Apr. 11, 2017", 20 pgs.
"U.S. Appl. No. 14/452,625, Final Office Action dated Jun. 13, 2016", 20 pgs.
"U.S. Appl. No. 14/452,625, Final Office Action dated Aug. 21, 2015", 17 pgs.
"U.S. Appl. No. 14/452,625, Non Final Office Action dated Jan. 12, 2016", 19 pgs.
"U.S. Appl. No. 14/452,625, Non Final Office Action dated Apr. 6, 2015", 15 pgs.
"U.S. Appl. No. 14/452,625, Non Final Office Action dated Oct. 21, 2016", 18 pgs.
"U.S. Appl. No. 14/452,625, Preliminary Amendment filed Nov. 21, 2014", 8 pgs.
"U.S. Appl. No. 14/452,625, Response filed Jan. 20, 2017 to Non Final Office Action dated Oct. 21, 2016", 7 pgs.
"U.S. Appl. No. 14/452,625, Response filed Apr. 12, 2016 to Non Final Office Action dated Jan. 12, 2016", 7 pgs.
"U.S. Appl. No. 14/452,625, Response Filed Jun. 12, 2017 to Final Office Action dated Apr. 11, 2017", 7 pgs.
"U.S. Appl. No. 14/452,625, Response filed Jul. 6, 2015 to Non Final Office Action dated Apr. 6, 2015", 8 pgs.
"U.S. Appl. No. 14/452,625, Response filed Aug. 15, 2016 to Final Office Action dated Jun. 13, 2016", 9 pgs.
"U.S. Appl. No. 14/452,625, Response filed Oct. 21, 2015 to Final Office Action dated Aug. 21, 2015", 7 pgs.
"U.S. Appl. No. 14/462,010, Final Office Action dated Dec. 2, 2015", 19 pgs.
"U.S. Appl. No. 14/462,010, Non Final Office Action dated May 28, 2015", 8 pgs.
"U.S. Appl. No. 14/462,010, Notice of Allowance dated Mar. 25, 2016", 12 pgs.
"U.S. Appl. No. 14/462,010, Response filed Mar. 2, 2016 to Final Office Action dated Dec. 2, 2015", 10 pgs.
"U.S. Appl. No. 14/462,010, Response filed Aug. 27, 2015 to Non Final Office Action dated May 28, 2015", 6 pgs.
"U.S. Appl. No. 14/543,173, Non Final Office Action dated Aug. 25, 2015", 14 pgs.
"U.S. Appl. No. 14/543,173, Preliminary Amendment filed Jul. 13, 2015", 7 pgs.
"U.S. Appl. No. 14/714,792, Final Office Action dated May 5, 2016", 7 pgs.
"U.S. Appl. No. 14/714,792, Non Final Office Action dated Oct. 8, 2015", 6 pgs.
"U.S. Appl. No. 14/714,792, Notice of Allowance dated Jul. 27, 2016", 9 pgs.
"U.S. Appl. No. 14/714,792, Response filed Jan. 7, 2016 to Non Final Office Action dated Oct. 8, 2015", 7 pgs.
"U.S. Appl. No. 14/714,792, Response filed Jul. 5, 2016 to Final Office Action dated May 5, 2016", 7 pgs.
"U.S. Appl. No. 14/920,446, Advisory Action dated Aug. 15, 2017", 2 pgs.
"U.S. Appl. No. 14/920,446, Final Office Action dated May 4, 2017", 9 pgs.
"U.S. Appl. No. 14/920,446, Non Final Office Action dated Sep. 22, 2016", 8 pgs.
"U.S. Appl. No. 14/920,446, Respons Filed Aug. 4, 2017 to Final Office Action dated May 4, 2017", 9 pgs.
"U.S. Appl. No. 14/920,446, Response filed Dec. 21, 2016 to Non Final Office Action dated Sep. 22, 2016", 8 pgs.
"U.S. Appl. No. 15/019,895, Non Final Office Action dated Dec. 29, 2016", 10 pgs.
"U.S. Appl. No. 15/019,895, Notice of Allowance dated May 25, 2017", 13 pgs.
"U.S. Appl. No. 15/019,895, Notice of Allowance dated May 25, 2017", 12 pgs.
"U.S. Appl. No. 15/019,895, Response filed Mar. 29, 2017 to Non Final Office Action dated Dec. 29, 2017", 7 pgs.
"U.S. Appl. No. 15/061,309, Final Office Action dated May 2, 2017", 7 pgs.
"U.S. Appl. No. 15/061,309, Non Final Office Action dated Nov. 28, 2016", 7 pgs.
"U.S. Appl. No. 15/061,309, Notice of Allowability dated Sep. 6, 2017", 2 pgs.
"U.S. Appl. No. 15/061,309, Notice of Allowability dated Sep. 12, 2017", 2 pgs.
"U.S. Appl. No. 15/061,309, Notice of Allowance dated Aug. 25, 2017", 14 pgs.
"U.S. Appl. No. 15/061,309, Preliminary Amendment filed Oct. 27, 2016", 6 pgs.
"U.S. Appl. No. 15/061,309, Response filed Aug. 1, 2017 to Final Office Action dated May 2, 2017", 6 pgs.
"U.S. Appl. No. 15/061,309, Response flied Feb. 28, 2017 to Non Final Office Action dated Nov. 28, 2016", 7 pgs.
"U.S. Appl. No. 15/236,978, Preliminary Amendment filed Oct. 26, 2016", 5 pgs.
"U.S. Appl. No. 15/362,447, Non Final Office Action dated Dec. 1, 2017", 8 pgs.

(56) References Cited

OTHER PUBLICATIONS

"U.S. Appl. No. 15/362,447, Notice of Allowance dated Apr. 11, 2018", 8 pgs.
"U.S. Appl. No. 15/362,447, Preliminary Amendment filed Feb. 6, 2017", 6 pgs.
"U.S. Appl. No. 15/362,447, Response Filed Feb. 20, 2018 to Non Final Office Action dated Dec. 1, 2017", 7 pgs.
"U.S. Appl. No. 15/714,626, Non Final Office Action dated Jun. 14, 2018", 15 pgs.
"U.S. Appl. No. 15/851,953, Non Final Office Action dated Mar. 29, 2019", 14 pgs.
"U.S. Appl. No. 15/851,953, Preliminary Amendment filed Feb. 12, 2019", 5 pgs.
"U.S. Appl. No. 15/851,953, Preliminary Amendment filed Apr. 9, 2018", 7 pgs.
"U.S. Appl. No. 15/851,953, Restriction Requirement dated Dec. 13, 2018", 7 pgs.
"U.S. Appl. No. 15/851,953, Supplemental Preliminary Amendment filed Apr. 11, 2018", 6 pgs.
"U.S. Appl. No. 16/057,168, Non Final Office Action dated Mar. 7, 2019", 10 pgs.
"U.S. Appl. No. 16/057,168, Notice of Allowance dated Jun. 24, 2019", 11 pgs.
"U.S. Appl. No. 16/057,168, Preliminary Amendment filed Apr. 14, 2006", 7 pgs.
"U.S. Appl. No. 16/057,168, Response filed Jun. 6, 2019 to Non Final Office Action dated Mar. 7, 2019", 7 pgs.
"U.S. Appl. No. 15/019,895, Examiner Interview Summary dated May 25, 2017", 1 pg.
"Canadian Application Serial No. 2,428,908, Office action dated Mar. 15, 2007", 6 pgs.
"Canadian Application Serial No. 2,428,908, Office action dated Nov. 4, 2008", 9 pgs.
"Canadian Application Serial No. 2,428,908, Response filed Sep. 17, 2007 to Office Action dated Mar. 15, 2007", 25 pgs.
"Chinese Application Serial No. 2,609,979, Response filed Aug. 16, 2011 to Office Action dated Apr. 12, 2011", w/English claims, 15 pgs.
"Chinese Application Serial No. 200680028085.8, Office Action dated Apr. 12, 2011", w/English translation, 3 pgs.
"Chinese Application Serial No. 200680028085.8, Office Action dated Sep. 30, 2011", w/English translation, 8 pgs.
"Chinese Application Serial No. 200680028085.8, Office Action dated Jun. 29, 2012", w/English translation, 8 pgs.
"Chinese Application Serial No. 200680028085.8, Response filed Apr. 13, 2012 to Office Action dated Sep. 30, 2011", w/English claims, 15 pgs.
"Chinese Application Serial No. 200680028085.8, Response filed Nov. 14, 2012 to Office Action dated Jun. 29, 2012", w/English claims, 14 pgs.
"European Application Serial No. 05791651.2, Office Action dated Mar. 15, 2011", 5 pgs.
"European Application Serial No. 06772250.4, Office Action dated Oct. 18, 2012", 5 pgs.
"European Application Serial No. 10252054.1, Extended Search Report dated Sep. 14, 2012", 6 pgs.
"European Application Serial No. 03253052, European Search Report dated Nov. 24, 2005", 2 pgs.
"European Application Serial No. 03253052.9, Communication of Notice of Opposition dated Sep. 24, 2012", (dated Sep. 24, 2012), 22 pgs.
"European Application Serial No. 03253052.9, Communication of Notice of Opposition dated Oct. 23, 2012", (dated Oct. 23, 2012), 1 pgs.
"European Application Serial No. 03253052.9, EPO Brief Communication dated Oct. 17, 2014", (dated Oct. 17, 2014), 6 pgs.
"European Application Serial No. 03253052.9, European Search Report dated Nov. 24, 2005", 2 pgs.
"European Application Serial No. 03253052.9, Office Action dated Mar. 26, 2009", 3 pgs.
"European Application Serial No. 03253052.9, Response filed May 2, 2013 to Notice of Opposition dated Sep. 24, 2012", (dated May 2, 2013), 36 pgs.
"European Application Serial No. 03253052.9, Response filed Oct. 5, 2009 to Office Action dated Mar. 26, 2009", 25 pgs.
"European Application Serial No. 03253052.9, Summons to Attend Oral Proceedings Mailed Mar. 13, 2014", (Mar. 13, 2014), 7 pgs.
"European Application Serial No. 03253052.9, Written Submission filed Oct. 13, 2014", (Oct. 13, 2014), 12 pgs.
"European Application Serial No. 05790836.0, Office Action dated Jun. 4, 2009", 3 pgs.
"European Application Serial No. 05791651.2, Examiner Interview Summary dated Mar. 28, 2012", (dated Mar. 28, 2012), 4 pgs.
"European Application Serial No. 05791651.2, Office Action Response Filed Jul. 7, 2011", 11 pgs.
"European Application Serial No. 05791651.2, Oral Proceedings mailed May 3, 2012", (May 3, 2012), 3 pgs.
"European Application Serial No. 05791651.2, Summons to Attend Oral Proceedings mailed Jan. 20, 2012", 4 pgs.
"European Application Serial No. 05791651.2, Written Decision to Refuse dated May 3, 2012", (dated May 3, 2012), 17 pgs.
"European Application Serial No. 05791651.2, Written Submission filed Mar. 16, 2012", (dated Mar. 16, 2012), 51 pgs.
"European Application Serial No. 06772250.4, Communication Pursuant to Article 94(3) EPC dated Sep. 17, 2015", 5 pgs.
"European Application Serial No. 06772250.4, Office Action dated Dec. 22, 2010", 3 pgs.
"European Application Serial No. 06772250.4, Response filed Apr. 25, 2013 to Office Action dated Oct. 18, 2012", 7 pgs.
"European Application Serial No. 06772250.4, Response filed Jun. 24, 2011 to Office Action dated Dec. 22, 2010", 18 pgs.
"European Application Serial No. 07250920.1, Response filed Aug. 22, 2014 to European Extended Search Report dated Jan. 23, 2014", 21 pgs.
"European Application Serial No. 07252582.7, Extended European Search Report dated Apr. 4, 2008", 7 pgs.
"European Application Serial No. 07252582.7, Office Action dated Feb. 6, 2009", 2 pgs.
"European Application Serial No. 07252582.7, Office Action dated Dec. 27, 2011", 4 pgs.
"European Application Serial No. 07252582.7, Response filed Apr. 20, 2011 to Office Action dated Oct. 15, 2010", 4 pgs.
"European Application Serial No. 07252582.7, Response filed Apr. 27, 2012 to Office Action dated Dec. 27, 2011", 3 pgs.
"European Application Serial No. 07252582.7, Response filed Aug. 11, 2009 to Office Communication dated Feb. 6, 2009", 2 pgs.
"European Application Serial No. 07252582.7.0, Office Action dated Oct. 15, 2010", 4 pgs.
"European Application Serial No. 07254947.0, Extended European Search Report dated Apr. 3, 2008", 6 pgs.
"European Application Serial No. 07254947.0, Office Action dated Aug. 25, 2008", 1 pgs.
"European Application Serial No. 07254947.0, Office Action dated Jan. 19, 2012", 5 pgs.
"European Application Serial No. 07254947.0, Office Action dated Oct. 12, 2010", 4 pgs.
"European Application Serial No. 07254947.0, Response filed Apr. 26, 2011 to Official Communication dated Oct. 12, 2010", 11 pgs.
"European Application Serial No. 07254947.0, Response filed Jul. 20, 2012 to Examination Notification Art. 94(3) dated Jan. 19, 2012", 9 pgs.
"European Application Serial No. 07254947.0, Response filed Feb. 28, 2009 to Official Communication dated Aug. 25, 2008", 2 pgs.
"European Application Serial No. 07254947.0, Summons to Attend Oral Proceedings mailed Nov. 7, 2014", 3 pgs.
"European Application Serial No. 10252054.1, Response filed Apr. 17, 2013 to Extended European Search Report dated Sep. 14, 2012", 23 pgs.
"European Application Serial No. 10252192.9, Examination Notification Art. 94(3) dated Jul. 8, 2015", 5 pgs.
"European Application Serial No. 10252192.9, Extended European Search Report dated Jan. 2, 2013", 8 pgs.

(56) References Cited

OTHER PUBLICATIONS

"European Application Serial No. 10252192.9, Response filed Jan. 18, 2016 to Examination Notification Art. 94(3) dated Jul. 8, 2015", 16 pgs.
"European Application Serial No. 10252192.9, Response filed Jul. 18, 2013 to Extended European Search Report dated Jan. 2, 2013", (dated Jul. 18, 2013).
"European Application Serial No. 11184383.5 , Summons to Attend Oral Proceedings mailed Aug. 29, 2013", (Aug. 29, 2013), 5 pgs.
"European Application Serial No. 11184383.5, Extended European Search Report dated Jul. 31, 2012", 7 pgs.
"European Application Serial No. 11184383.5, Office Action dated Mar. 8, 2013", 7 pgs.
"European Application Serial No. 11184383.5, Response filed Feb. 14, 2013 to Extended European Search Report dated Jul. 31, 2012", 23 pgs.
"European Application Serial No. 11184383.5, Response filed Jul. 12, 2013 to Office Action dated Mar. 8, 2013", 11 pgs.
"European Application Serial No. 11184383.5, Summons to Attend Oral Proceedings mailed Aug. 29, 2013", 5 pgs.
"European Application Serial No. 11250442.8, Examination Notification Art. 94(3) dated Mar. 25, 2015", 5 pgs.
"European Application Serial No. 11250442.8, Extended European Search Report dated Aug. 18, 2011", 6 pgs.
"European Application Serial No. 11250442.8, Response filed Apr. 17, 2012 to Extended Search Report dated Aug. 18, 2011", 28 pgs.
"European Application Serial No. 11250442.8, Response filed Jul. 30, 2015 to Examination Notification Art. 94(3) dated Mar. 25, 2015", 11 pgs.
"European Application Serial No. 13150071.2, Extended European Search Report dated Feb. 15, 2013", 7 pgs.
"European Application Serial No. 13150071.2, Response filed Oct. 17, 2013 to Extended European Search Report dated Feb. 15, 2013", 23 pgs.
"European Application Serial No. 13176910.1, Communication Pursuant to Article 94(3) EPC dated Nov. 29, 2016", 6 pgs.
"European Application Serial No. 13176910.1, Extended European Search Report dated Jan. 23, 2014", 9 pgs.
"European Application Serial No. 13176910.1, Response filed Jun. 9, 2017 to Communication Pursuant to Article 94(3) EPC dated Nov. 29, 2016", 8 pgs.
"European Application Serial No. 14177405.9, Extended European Search Report dated Jan. 5, 2015", (dated Jan. 5, 2015), 7 pgs.
"European Application Serial No. 14177405.9, Response filed Jul. 21, 2015 to Extended European Search Report dated Jan. 5, 2015", 11 pgs.
"European Application Serial No. 14187742.3, Communication Pursuant to Article 94(3) EPC dated Oct. 12, 2016", 5 pgs.
"European Application Serial No. 14187742.3, Extended European Search Report dated Dec. 1, 2014", 6 pgs.
"European Application Serial No. 14187742.3, Response filed Apr. 27, 2017 to Communication Pursuant to Article 94(3) EPC dated Oct. 12, 2016", 23 pgs.
"European Application Serial No. 14187742.3, Response filed Jul. 14, 2015 to Extended European Search Report dated Dec. 1, 2014", 36 pgs.
"European Application Serial No. 17198644.1, Extended European Search Report dated Feb. 15, 2018", 8 pgs.
"Hearing Aids—Part 12: Dimensions of electrical connector systems", IEC 118-12, (1996), 24 pgs.
"Hearing Aids—Part 6: Characteristics of electrical input circuits for hearing aids", IEC 60118-6, (1999), 12 pgs.
"Impedance-matching devices, L-section and Transmission lines", Wikipedia, Sections, [Online] retrieved from the internet: <https://en.wikipedia.org/wiki/Impedance_matching>, (Accessed Date—Feb. 14, 2017), 13 pgs.
"International Application Serial No. PCT/US2005/029793, International Preliminary Report on Patentability dated Mar. 1, 2007", 5 pgs.
"International Application Serial No. PCT/US2005/029793, International Search Report dated Jan. 5, 2006", 7 pgs.
"International Application Serial No. PCT/US2005/029793, Written Opinion dated Jan. 5, 2006", 4 pgs.
"International Application Serial No. PCT/US2005/029971, International Preliminary Report on Patentability dated Mar. 1, 2007", 6 pgs.
"International Application Serial No. PCT/US2005/029971, International Search Report dated Jan. 5, 2006", 7 pgs.
"International Application Serial No. PCT/US2005/029971, Written Opinion dated Jan. 5, 2006", 4 pgs.
"International Application Serial No. PCT/US2006/021870, International Preliminary Report on Patentability dated Dec. 6, 2007", 8 pgs.
"International Application Serial No. PCT/US2006/021870, International Search Report and Written Opinion dated Nov. 3, 2006", 13 pgs.
"International Application Serial No. PCT/US2016/017214, International Preliminary Report on Patentability dated Aug. 24, 2017", 9 pgs.
"International Application Serial No. PCT/US2016/017214, International Search Report dated Jun. 10, 2016", 4 pgs.
"International Application Serial No. PCT/US2016/017214, Written Opinion dated Jun. 10, 2016", 7 pgs.
"Kleer Announces Reference Design for Wireless Earphones", [Online]. Retrieved from the Internet: <URL:http://kleer.com/newsevents/press_releases/prjan2.php>, (Jan. 2, 2007), 2 pgs.
"Korean Application Serial No. 10-2008-7000332, Office Action dated Aug. 15, 2012", w/English translation, 9 pgs.
"Korean Application Serial No. 10-2008-7000332, Response filed Oct. 15, 2012 to Office Action dated Aug. 15, 2012", w/English claims, 22 pgs.
"Korean Application Serial No. 10-2008-7000332, Voluntary Amendment filed Jun. 9, 2011", w/English Translation, 14 pgs.
"Technical Data Sheet—Microphone Unit 6903", Published by Microtronic, (Dec. 2000), 2 pgs.
Beck, L. B., "The "T" Switch; Some Tips for Effective Use", Shhh, (Jan./Feb. 1989), 12-15.
Birger, Kollmeier, et al., "Real-time multiband dynamic compression and noise reduction for binaural hearing aids", Journal of Rehabilitation Research and Developement, vol. 30, No. 1, (Jan. 1, 1993), 82-94.
Davis, A., et al., "Magnitude of Diotic Summation in Speech-in-Noise Tasks: Performance Region and Appropriate Baseline", British Journal of Audiology, 24, (1990), 11-16.
Gilmore, R., "Telecoils: past, present & future", Hearing Instruments, 44 (2), (1993), 22-23, 26-27, 40.
Greefkes, J. A, et al., "Code Modulation with Digitally Controlled Companding for Speech Transmission", Philips Tech. Rev., 31(11/12), (1970), 335-353.
Griffing, Terry S, et al., "Acoustical Efficiency of Canal ITE Aids", Audecibel, (1983), 30-31.
Griffing, Terry S, et al., "Custom canal and mini in-the-ear hearing aids", Hearing Instruments, vol. 34, No. 2, (Feb. 1983), 31-32.
Griffing, Terry S, et al., "How to evaluate, sell, fit and modify canal aids", Hearing Instruments, vol. 35, No. 2, (Feb. 1984), 3 pgs.
Haartsen, J., "Bluetooth-The Universal Radio Interface for Ad Hoc, Wireless Connectivity", Ericsson Review, No. 3, (1998), 110-117.
Halverson, H. M., "Diotic Tonal Volumes as a Function of Difference of Phase", The American Journal of Psychology, 33(4), (Oct. 1922), 526-534.
Hansaton Akustik GmbH, "48 K-Amp Contactmatic", (from Service Manual), (Apr. 1996), 8 pgs.
Lacanette, Kerry, "A Basic Introduction to Filters—Active, Passive, and Switched-Capacitor", National Semiconductor Corporation, http://www.swarthmore.edu/NatSci/echeeve1/Ref/DataSheet/Inttofilters.pdf, (Apr. 1991), 1-22.
Lindemann, "Two microphone nonlinear frequency domain beamformer for hearing aid noise reduction", IEEE ASSP Workshop on Applications of Signal Processing to Audio and Acoustics, (Oct. 1995), 24-27.

(56) References Cited

OTHER PUBLICATIONS

Lindemann, Eric, "Two Microphone Nonlinear Frequency Domain Beamformer for Hearing Aid Noise Reduction", Proc. IEEE Workshop on Applications of Signal Processing to Audio and Acoustics, (1995), 24-27.
Liu, Tao, et al., "Performance Evaluation of Link Quality Estimation Metrics for Static Multihop Wireless Sensor Networks", Mesh and Ad Hoc Communications and Networks Secon '09. 6th Annual IEEE Communications Society Conference on, IEEE, Piscataway, (Jun. 22, 2009), 1-9.
Lybarger, S. F, "Development of a New Hearing Aid with Magnetic Microphone", Electrical Manufacturing, (Nov. 1947), 11 pgs.
Mahon, William J, "Hearing Aids Get a Presidential Endorsement", The Hearing Journal (Oct. 1983), 7-8.
Olivier, Roy, "Distributed Signal Processing for Binaural Hearing Aid", [Online]. Retrieved from Internet:<http://infoscience.epfl.ch/record/126277/files/EPFL TH4220.pdf?version=1>, (Jan. 1, 2008), 1-143.
Olivier, Roy, et al., "Rate-Constrained Collaborative Noise Reduction for Wireless Hearing Aid", IEEE Transactions on signal Processing, IEEE Service center, New York, NY, US, vol. 57, No. 2, (Feb. 1, 2009), 645-657.
Peissig, J., et al., "Directivity of binaural noise reduction in spatial multiple noise-source arrangements for normal and impaired listeners", J Acoust Soc Am., 101(3), (Mar. 1997), 1660-70.
Preves, D. A., "A Look at the Telecoil—It's Development and Potential", SHHH Journal, (Sep./Oct. 1994), 7-10.
Preves, David A., "Field Trial Evaluations of a Switched Directional/Omnidirectional In-the-Ear Hearing Instrument", Journal of the American Academy of Audiology, 10(5), (May 1999), 273-283.
Schaefer, Conrad, "Letter referencing Micro Ear Patent", (Aug. 22, 2002), 2 pgs.
Srinivasan, S., "Low-bandwidth binaural beamforming", IEEE Electronics Letters, 44(22), (Oct. 23, 2008), 1292-1293.
Srinivasan, Sriram, et al., "Beamforming under Quantization Errors in Wireless Binaural Hearing Aids", EURASIP Journal on Audio, Speech, and Music Processing, vol. 2008, Article ID 824797, (Jan. 28, 2008), 8 pgs.
Sullivan, Roy F, "Custom canal and concha hearing instruments: A real ear comparison Part I", Hearing Instruments, vol. 40, No. 4, (Jul. 1989), 23-29.
Sullivan, Roy F, "Custom canal and concha hearing instruments: A real ear comparison Part II", Hearing Instruments, vol. 40, No. 7, (Jul. 1989), 30-36.
Teder, Harry, "Something New in CROS", Hearing Instruments, vol. 27, No. 9, Published by Harcourt Brace Jovanovich, (Sep. 1976), 18-19.
Valente, Michael, et al., "Audiology: Treatment", Thieme Medical Publishers, (Mar. 1, 2000), 594-599.
Vivek, Goyal K, "Theoretical Foundations of Transform Coding", IEEE Single Processing Magazine, IEEE Service center, Piscataway, NJ, US, vol. 18, No. 5, (Sep. 1, 2001), 9-21.
Zelnick, E., "The Importance of Interaural Auditory Differences in Binaural Hearing", Binaural Hearing and Amplification, vol. 1, (1980), 81-103.
"U.S. Appl. No. 15/714,626, Advisory Action dated Feb. 8, 2019", 3 pgs.
"U.S. Appl. No. 15/714,626, Final Office Action dated Nov. 23, 2018", 16 pgs.
"U.S. Appl. No. 15/714,626, Non Final Office Action dated Mar. 15, 2019", 13 pgs.
"U.S. Appl. No. 15/714,626, Notice of Allowability dated Aug. 12, 2019", 2 pgs.
"U.S. Appl. No. 15/714,626, Notice of Allowance dated Jul. 16, 2019", 9 pgs.
"U.S. Appl. No. 15/714,626, Response Filed Jan. 22, 2019 to Final Office Action dated Nov. 23, 2018", 9 pgs.
"U.S. Appl. No. 15/714,626, Response Filed Sep. 6, 2018 to Non Final Office Action dated Jun. 14, 2018", 8 pgs.
"U.S. Appl. No. 15/715,626, Response filed Jun. 17, 2019 to Non-Final Office Action dated Mar. 15, 2019", 8 pgs.
"U.S. Appl. No. 15/851,953, Notice of Allowance dated Aug. 14, 2019", 10 pgs.
"U.S. Appl. No. 15/851,953, Response filed Jun. 27, 2019 to Non-Final Office Action dated Mar. 29, 2019", 7 pgs.
U.S. Appl. No. 11/619,541, filed Jan. 3, 2007, Wireless System for Hearing Communication Devices Providing Wireless Stereo Reception Modes, U.S. Pat. No. 8,041,066.
U.S. Appl. No. 13/270,860, filed Oct. 11, 2011, Wireless System for Hearing Communication Devices Providing Wireless Stereo Reception Modes, U.S. Pat. No. 8,515,114.
U.S. Appl. No. 13/970,368, filed Aug. 19, 2013, Wireless System for Hearing Communication Devices Providing Wireless Stereo Reception Modes, U.S. Pat. No. 9,282,416.
U.S. Appl. No. 15/061,309, filed Mar. 4, 2016, Wireless System for Hearing Communication Devices Providing Wireless Stereo Reception Modes, U.S. Pat. No. 9,854,369.
U.S. Appl. No. 15/851,953, filed Dec. 22, 2017, Wireless System for Hearing Communication Devices Providing Wireless Stereo Reception Modes.
U.S. Appl. No. 13/464,419, filed May 4, 2012, Method and Apparatus for a Binaural Hearing Assistance System Using Monaural Audio Signals, U.S. Pat. No. 9,036,823.
U.S. Appl. No. 11/456,538, filed Jul. 10, 2006, Method and Apparatus for a Binaural Hearing Assistance System Using Monaural Audio Signals, U.S. Pat. No. 8,208,642.
U.S. Appl. No. 14/714,792, filed May 18, 2015, Method and Apparatus for a Binaural Hearing Assistance System Using Monaural Audio Signals, U.S. Pat. No. 9,510,111.
U.S. Appl. No. 15/362,447, filed Nov. 28, 2016, Method and Apparatus for a Binaural Hearing Assistance System Using Monaural Audio Signals, U.S. Pat. No. 10,051,385.
U.S. Appl. No. 16/057,168, filed Aug. 7, 2018, Method and Apparatus for a Binaural Hearing Assistance System Using Monaural Audio Signals, U.S. Pat. No. 10,469,960.
U.S. Appl. No. 12/649,648, filed Dec. 30, 2009, Noise Reduction System for Hearing Assistance Devices, U.S. Pat. No. 8,737,653.
U.S. Appl. No. 14/188,104, filed Feb. 24, 2014, Noise Reduction System for Hearing Assistance Devices, U.S. Pat. No. 9,204,227.
U.S. Appl. No. 14/954,078, filed Nov. 30, 2015, Noise Reduction System for Hearing Assistance Devices.
U.S. Appl. No. 10/146,536, filed May 15, 2002, Diotic Presentation of Second-Order Gradient Directional Hearing Aid Signals, U.S. Pat. No. 7,369,669.
U.S. Appl. No. 12/115,423, filed May 5, 2008, Hearing Assistance Systems for Providing Second-Order Gradient Directional Signals, U.S. Pat. No. 7,822,217.
"U.S. Appl. No. 16/703,332, Preliminary Amedment filed Dec. 5, 2019", 6pgs.

* cited by examiner

METHOD AND APPARATUS FOR A BINAURAL HEARING ASSISTANCE SYSTEM USING MONAURAL AUDIO SIGNALS

CLAIM OF PRIORITY

This application is a continuation of and claims the benefit of priority under 35 U.S.C. § 120 to U.S. patent application Ser. No. 16/057,168, filed Aug. 7, 2018, now issued as U.S. Pat. No. 10,469,960, which is a continuation of and claims the benefit of priority under 35 U.S.C. § 120 to U.S. patent application Ser. No. 15/362,447, filed Nov. 28, 2016, now issued as U.S. Pat. No. 10,051,385, which is a continuation of and claims the benefit of priority under 35 U.S.C. § 120 to U.S. patent application Ser. No. 14/714,792, filed May 18, 2015, now issued as U.S. Pat. No. 9,510,111; which is a continuation of and claims the benefit of priority under 35 U.S.C. § 120 to U.S. patent application Ser. No. 13/464,419, filed on May 4, 2012, now issued as U.S. Pat. No. 9,036,823; which application is a continuation of and claims the benefit of priority under 35 U.S.C. § 120 to U.S. patent application Ser. No. 11/456,538, filed on Jul. 10, 2006, now issued as U.S. Pat. No. 8,208,642, which applications are incorporated herein by reference in their entirety.

FIELD OF THE INVENTION

This application relates generally to method and apparatus for a hearing assistance system, and more particularly to method and apparatus for a binaural hearing assistance system using a monaural audio signal.

BACKGROUND

Modern wireless audio devices frequently apply a monaural signal to a single ear. For example, devices such as cell phones and cellular headsets receive monaural communications for application to a single ear. By this approach, many advantages of binaural hearing are lost. Such devices only apply sound to one ear, so hearing can be impaired by loud noises in the other ear, and hearing can be impaired by hearing limitations associated with a particular ear.

Thus, there is a need in the art for an improved hearing assistance system which provides the advantages of binaural hearing for listening to a monaural signal. The system should be controllable to provide better hearing, convenience, and an unobtrusive design. In certain variations, the system may also allow a user to customize his or her hearing experience by controlling the sounds received by the system.

SUMMARY

This application addresses the foregoing need in the art and other needs not discussed herein. The various embodiments described herein relate to a wireless system for binaural hearing assistance devices.

One embodiment includes an apparatus for a user having a first ear and a second ear, including a wireless device to transmit a signal containing monaural information; a first hearing assistance device including: a first radio receiver to receive the signal; an adjustable phase shifter adapted to apply a plurality of controllable, incremental phase shifts to the monaural information on the signal; and a first speaker to produce a first audio signal for the first ear; and a second hearing assistance device including a second radio receiver and a second speaker to produce a second audio signal for the second ear, wherein the first and second audio signals are produced with adjustable relative phase based on a setting of the adjustable phase shifter. Various embodiments provide adjustable level controls and microphones in combinations of first and/or second hearing assistance devices. Some applications include communications between cellular devices, such as cellular phones and hearing aids. Various embodiments provide applications using wireless audio controllers having packetized audio. Both manual and automatic adjustments are provided. In various embodiments, different combinations of receivers and sensors, such as magnetic field sensors, are provided. In various embodiments, processing adapted to account for head-related transfer functions and for controlling the electronics using it are provided.

In one embodiment, a system is provided for a user having a first ear and a second ear, including: a device comprising a controllable phase shifter adapted to receive a monaural information signal and convert it into a first monaural signal and a second monaural signal, the first and second monaural signals having an interaural phase shift; a first hearing assistance device including: a first receiver adapted to receive the first monaural signal; and a first speaker to produce a first audio signal for the first ear; and a second hearing assistance device including: a second receiver adapted to receive the second monaural signal; and a second speaker to produce a second audio signal for the second ear. Various embodiments provide adjustable level controls and microphones in combinations of first and/or second hearing assistance devices. Some applications include communications between cellular devices, such as cellular phones and hearing aids. Various embodiments provide applications using wireless audio controllers having packetized audio. Both manual and automatic adjustments are provided. In various embodiments, different combinations of receivers and sensors, such as magnetic field sensors, are provided. In various embodiments, processing adapted to account for head-related transfer functions and for controlling the electronics using it are provided.

Methods are also provided, including for example, a method for providing sound to a first ear and a second ear of a wearer of first and second hearing assistance devices, including: receiving a monaural information signal; converting the monaural information signal into a first monaural signal and a second monaural signal, the first and second monaural signals differing in relative phase which is controllable; and providing a first sound based on the first monaural signal to the first ear of the wearer and a second sound based on the second monaural signal to the second ear of the wearer to provide binaural sound to the wearer. Different applications, including different methods for lateralizing perceived sounds and levels of perceived sounds, are provided. Different embodiments for methods of use, including sensing telephone (telecoil) modes, are provided. Different embodiments for applications employing head-related transfer functions and relaying are also provided. A variety of different interaural delays and phase changes are provided. Other embodiments not expressly mentioned in this Summary are found in the detailed description.

This Summary is an overview of some of the teachings of the present application and not intended to be an exclusive or exhaustive treatment of the present subject matter. Further details about the present subject matter are found in the detailed description and appended claims.

BRIEF DESCRIPTION OF THE DRAWINGS

Various embodiments are illustrated by way of example in the figures of the accompanying drawings.

DETAILED DESCRIPTION

In the following description, for purposes of explanation, numerous specific details are set forth in order to provide a thorough understanding of the various embodiments. It will be apparent, however, to one skilled in the art that the various embodiments may be practiced without some of these specific details. The following description and drawings provide examples for illustration, and are not intended to provide an exhaustive treatment of all possible implementations.

It should be noted that references to "an", "one", or "various" embodiments in this disclosure are not necessarily to the same embodiment, and such references contemplate more than one embodiment.

The present subject matter presents sound to both ears of a user wearing wireless hearing assistance devices which is derived from a single monaural signal. Among other things, it allows for better control of the received sound and obtains benefits of binaural hearing for listening to the monaural signal. In various embodiments, the sound presented to one ear is phase shifted relative to the sound presented to the other ear. In various embodiments, the phase shift arises from a constant time delay. In various embodiments, the phase shift arises from a constant phase shift at all frequencies. In various embodiments, the phase shift arises from a phase shift that is varying as a function of frequency. In various embodiments, the sound presented to one ear is set to a different level relative to the sound presented to the other ear. In various embodiments, the sound presented to one ear is controllable in relative phase and in relative level with respect to the sound presented to the other ear. Various apparatus and method set forth herein can be employed to accomplish these embodiments and their equivalents. Other variations not expressly set forth herein exist which are within the scope of the present subject matter. Thus, the examples provided herein demonstrate various aspects of the present subject matter and are not intended to be limiting or exclusive.

Figure 1A:
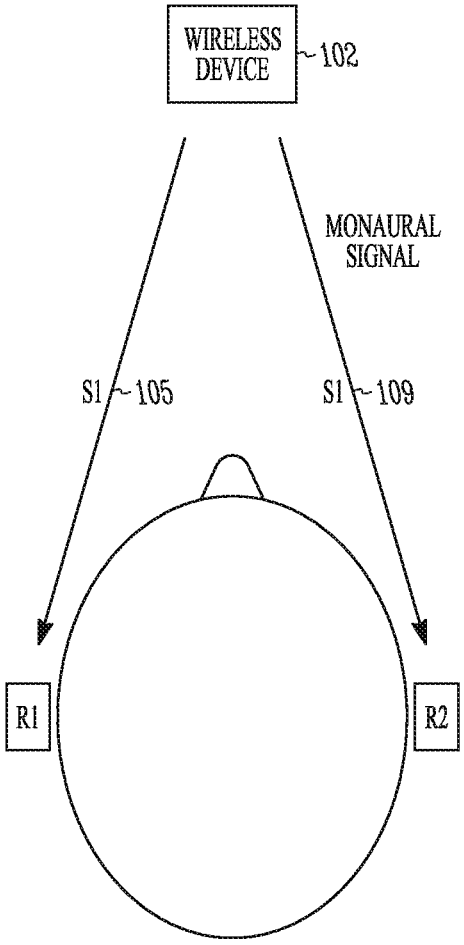
FIG. 1A shows one system using devices in a direct communication mode according to one embodiment of the present subject matter.

FIG. 1A shows one system using devices in a direct communication mode according to one embodiment of the present subject matter. In various embodiments, wireless device 102 supports one or more communication protocols. In various embodiments, communications of far field signals are supported. Some embodiments employ 2.4 GHz communications. In various embodiments the wireless communications can include standard or nonstandard communications. Some examples of standard wireless communications include, but are not limited to, FM, AM, SSB, BLUETOOTH™, IEEE 802.11 (wireless LANs) Wi-Fi, 802.15 (WPANs), 802.16 (WiMAX), 802.20, and cellular protocols including, but not limited to CDMA and GSM, ZigBee, and ultra-wideband (UWB) technologies. Such protocols support radio frequency communications and some support infrared communications. It is possible that other forms of wireless communications can be used such as ultrasonic, optical, and others. It is understood that the standards which can be used include past and present standards. It is also contemplated that future versions of these standards and new future standards may be employed without departing from the scope of the present subject matter.

Such wireless devices 102 include, but are not limited to, cellular telephones, personal digital assistants, personal computers, streaming audio devices, wide area network devices, local area network devices, personal area network devices, and remote microphones. In various embodiments, the wireless device 102 includes one or more of the interface embodiments demonstrated in U.S. Provisional Patent Application Ser. No. 60/687,707, filed Jun. 5, 2005, entitled: COMMUNICATION SYSTEM FOR WIRELESS AUDIO DEVICES, and U.S. patent application Ser. No. 11/447,617, filed Jun. 5, 2006, entitled: COMMUNICATION SYSTEM FOR WIRELESS AUDIO DEVICES which claims the benefit of the provisional application, the entire disclosures of which are hereby incorporated by reference. This is also applicable to wireless devices 202, 302, and 402 as described herein.

In the embodiment demonstrated by FIG. 1A, the listener has primary and secondary wireless hearing assistance devices R1 and R2. The wireless hearing assistance devices include, but are not limited to, various embodiments of hearing aids. In one embodiment, at least one wireless hearing assistance device is a behind-the-ear hearing aid. In one embodiment, at least one wireless hearing assistance device is an in-the-ear hearing aid. In one embodiment, at least one wireless hearing assistance device is a completely-in-the-canal hearing aid. In one embodiment, at least one wireless hearing assistance device is a wireless earpiece. In one embodiment, at least one wireless hearing assistance device is a behind-the-ear hearing aid with a wireless adaptor attached. Various examples of wireless adapters for some hearing assistance devices using a direct-audio input (DAI) interface are demonstrated in U.S. patent application Ser. No. 11/207,591, filed Aug. 18, 2005, entitled "WIRELESS COMMUNICATIONS ADAPTER FOR A HEARING ASSISTANCE DEVICE;" and PCT Patent Application No. PCT/US2005/029971, filed Aug. 18, 2005, entitled "WIRELESS COMMUNICATIONS ADAPTER FOR A HEARING ASSISTANCE DEVICE," the entire disclosures of which are incorporated by reference.

In the system of FIG. 1A, the communication protocol of wireless device 102 is adapted to controllably provide wireless communications 105, 109 to both the primary wireless hearing assistance device R1 and the secondary wireless hearing assistance device R2. In various embodiments, the communications are unidirectional. In various embodiments, the communications are bidirectional. In various embodiments, the communications include at least one unidirectional communication and one bidirectional communication. Thus, the system is highly programmable to adapt to a number of communication requirements and applications. The system is adapted to provide binaural information to both R1 and R2 based a monaural signal from wireless device 102.

In embodiments using BLUETOOTH as the communication protocol, it is noted that BLUETOOTH is normally directed for point-to-point communications using PINs (personal identification numbers), such that the wireless device 102 is typically paired with only one other device, such as primary device R1. Thus, to allow the wireless device 102 to also communicate with secondary device R2, a second pairing must be done, whether by standard or nonstandard means.

Figure 1B:
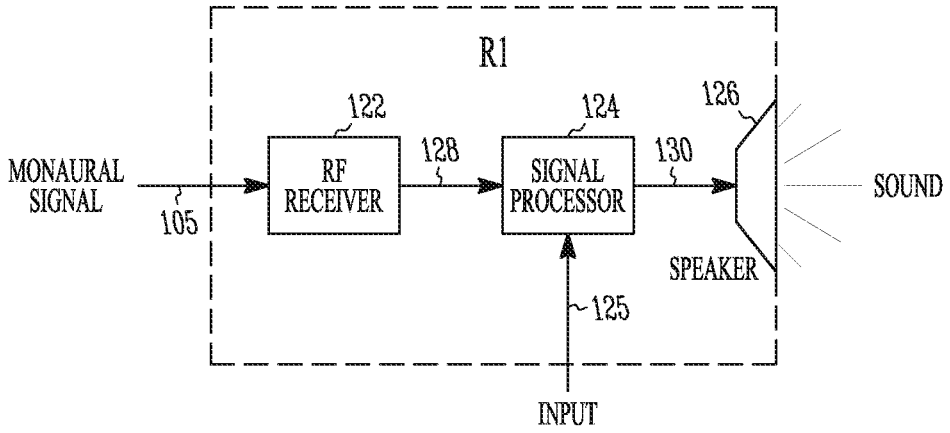
FIG. 1B shows a block diagram of signal flow in a hearing assistance device according to one embodiment of the present subject matter.

FIG. 1B shows a block diagram of signal flow in a hearing assistance device according to one embodiment of the present subject matter. For purposes of demonstration, this block diagram will be that of wireless audio device R1. However, it is understood that R2 or any other wireless audio device receiving the monaural signal from wireless device 102 could employ the subject matter of FIG. 1B without departing from the scope of the present subject matter.

The monaural signal 105 is received by receiver 122 which demodulates the signal and provides the audio signal 128 to signal processor 124. Signal processor 124 processes the signal to provide signal 130, which is then sent to speaker 126 to play the processed signal 130 to one ear of a wearer of R1. Various inputs from a user or from other external programming means may be employed to provide control to the signal processing performed by signal processor 124. These inputs can be accomplished with a variety of switches, and or programming ports, as needed to provide signal processing selections and/or parameters for the system.

In one embodiment, signal processor 124 is a digital signal processor. In one embodiment, signal processor 124 comprises hardware and software to accomplish the signal processing task. In one embodiment, signal processor 124 employs dedicated hardware in combination with other computational or digital signal processing hardware to perform the signal processing task. It is understood that a separate amplifier may be used for amplifying the signal 130 before sending it to speaker 126 as is known in the art. Thus, FIG. 1B is intended to demonstrate the basic operational blocks at one level and is not intended to be exclusive or exhaustive of the expressions of the present subject matter.

Figure 1C:
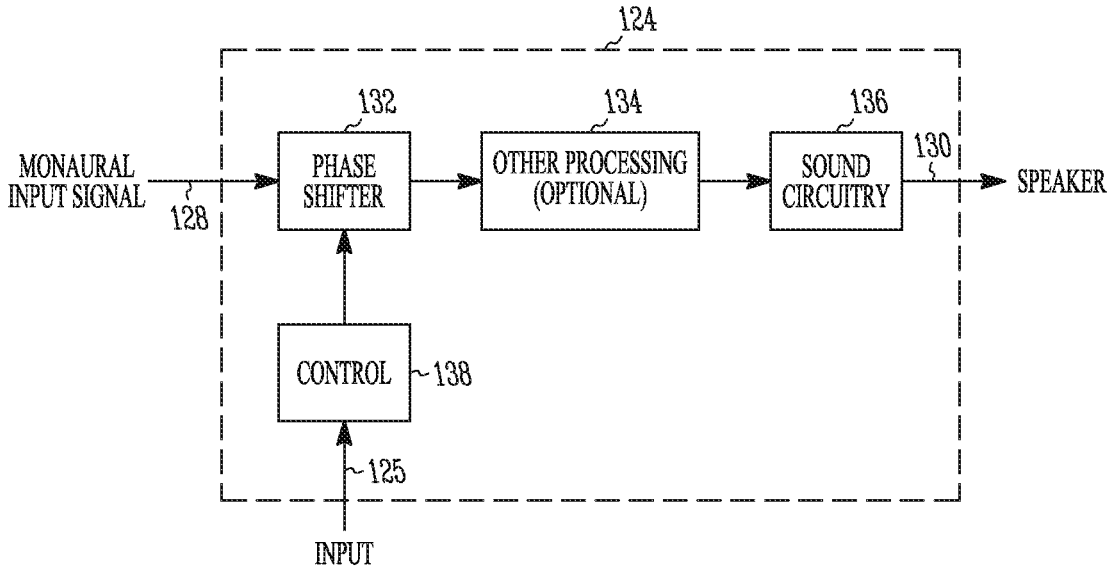
FIG. 1C shows detail of the signal processing block of FIG. 1B according to one embodiment of the present subject matter.

FIG. 1C shows detail of the signal processing block 124 of FIG. 1B according to one embodiment of the present subject matter. In this example, the monaural input signal 128 is processed by phase shifter 132 to provide a phase shifted version of the input signal 128. In various embodiments, the phase shift arises from a constant time delay applied to input signal 128. In various embodiments, the phase shift arises from a constant phase shift at all frequencies applied to input signal 128. In various embodiments, the phase shift arises from a phase shift that is varying as a function of frequency. Thus, control 138 provides some form of setting for adjusting phase shift and/or for selecting the type of phase shift to be applied. In one embodiment, the signal 125 is provided by a source external to the hearing assistance device R1 to control the phase shift. Various means for supplying signal 125 include one or more of switches operable by the user, soft switches programmed by a programming device attached to the hearing assistance device, or any combination of such inputs. Furthermore, in various embodiments, signal 125 may be internally generated by systems within the programming device to provide phase shift control as a function of one or more of sound received, conditions detected, and other processes requiring a change of either phase shift amount and/or mode. The signal 125 may also be transmitted and received by the device to adjust its operation.

For example, signal 125 could be generated as a result of a telephone device in proximity to the hearing assistance device to lateralize received sounds to the ear proximal the telephone. As another example, signal 125 can be generated to discontinue phase adjustment when the user receives a wireless signal indicating a ringing telephone. As another example, signal 125 can be generated to discontinue phase adjustment when detecting an emergency vehicle or other siren in proximity. Many other applications and operations of the system are possible without departing from the scope of the present subject matter. Those provided herein are intended to be demonstrative and not exhaustive or limiting of the present subject matter.

FIG. 1C also shows the phase shifted signal may optionally be processed for other effects by processor 134. The resulting signal is sent to amplifier circuit 136 to generate output 130 for speaker 126. Processor 134 allows further adjustment of the signal, including level adjustment. For example, the level and phase of the signal 130 can be programmably controlled, in one embodiment. If the hearing assistance device on the other ear (e.g., R2) does not adjust phase or level, then by controlling R1 a wearer of the hearing assistance devices R1 and R2 can experience both interaural level differences and interaural time/phase differences that are adjustable and controllable.

In applications where both R1 and R2 include the system of FIGS. 1A-1C, the settings of both devices can be adjusted to achieve desired interaural level and interaural time/phase differences. One way of communicating settings to both devices is to use signals embedded in the monaural information signals S1 that are received by R1 and R2. Thus, the monaural information is identical in such embodiments, but the signals provided may be used to adjust R1 relative to R2. Such embodiments require processing on wireless device 102 to provide appropriate control of R1 with respect to R2. It is understood that in one embodiment, such systems may employ a signaling that adjusts only R1, leaving R2 to operate without adjustment. In one embodiment, both R1 and R2 receive signals that adjust both devices to relatively provide the desired interaural level and/or interaural time/phase differences. In other embodiments, the signals for such interaural differences are generated within R1 and/or R2. For example, in a telephone sensing embodiment, the electronics of R1 may include a magnetic field sensor which programs R1 to shift to a telecoil mode (thereby turning off or diminishing the local microphone-received sound of the hearing assistance device R1) when a telephone is detected at or near R1. Many other embodiments and applications are possible without departing from the scope of the present subject matter.

Figure 2:
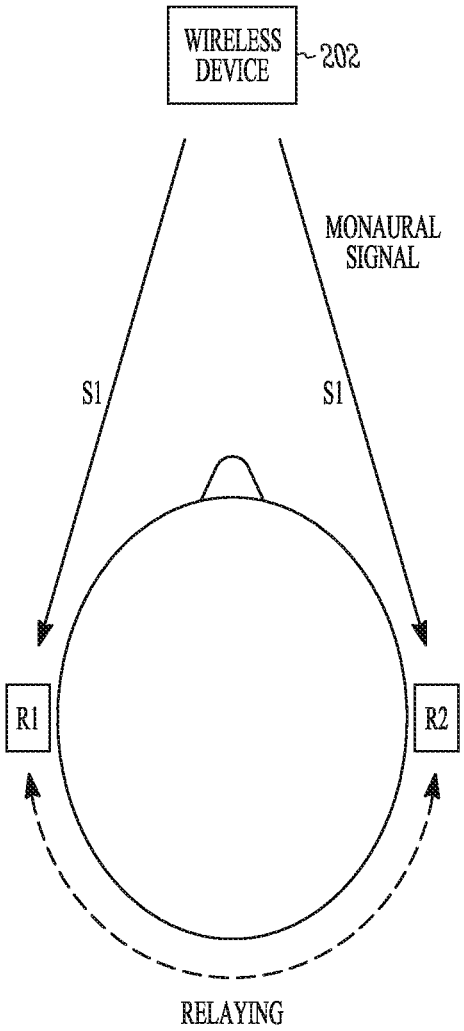
FIG. 2 shows one system of devices in a relaying communication mode according to one embodiment of the present subject matter.

Other signaling and communications modes may be accomplished without departing from the scope of the present subject matter. For example, FIG. 2 shows one system of devices in a relaying communication mode according to one embodiment of the present subject matter. The relaying can be of control signals, audio signals, or a combination of both. The relaying can be accomplished to perform functions adjusting phase and amplitude of both R1 and R2 and provides the ability to control lateralization and volume of the monaural signal to both ears. For example, when one ear detects a telephone signal, the relayed signal could include instructions to shut off or diminish the local received sound to the other ear to better hear the caller. The relayed signal could also lateralize the sound to the device detecting the phone to enjoy the enhanced benefits of binaural reception of the caller. Such embodiments can provide relaying of the caller's voice to the ear without the telephone against it, albeit at the proper phase and level to properly lateralize the sound of the caller's voice.

New virtual communication modes are also possible. When used in conjunction with telecommunications equipment, the system could provide a virtual handheld phone function without the user ever picking up the phone. For example, with this system, the user may answer his/her telephone (signaled from a ringing telephone), engage in a wireless session with his/her phone (e.g., Bluetooth communications with a cellular phone), and the system will programmably and automatically lateralize sound to a desired ear for binaural reception of the caller. All these activities can be performed without ever having to pick the phone up or place it near the ear. Those of skill in the art will readily appreciate a number of other applications within the scope of the present subject matter.

In some embodiments, it is possible to also insert special audio information for playing to one or more ears based on events. For example, given the previous example of virtual phone, a voice could play when caller identification identifies the caller to let the wearer know who the caller is and to decide whether to answer his/her phone.

Other applications too numerous to mention herein are possible without departing from the scope of the present subject matter.

Figure 3:
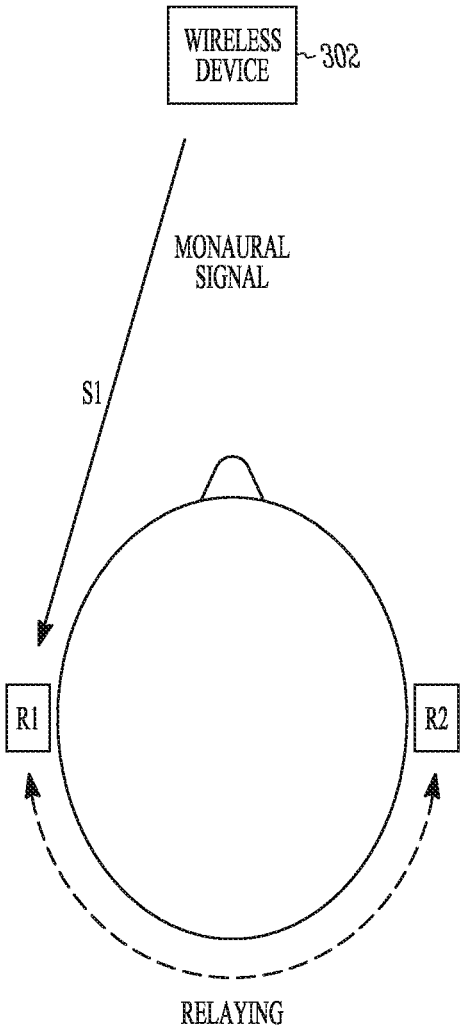
FIG. 3 shows one system of devices in a relaying communication mode according to one embodiment of the present subject matter.

FIG. 3 shows one system of devices in a relaying communication mode according to one embodiment of the present subject matter. In the embodiment of FIG. 3 it is possible to allow one receiver (e.g., R1) to be used to receive the monaural signal S1 and thereby relay the audio and/or control information to a second receiver (R2) in a relaying mode. The information communicated from wireless device 302 to primary device R1 is retransmitted to secondary device R2. Such systems have an additional time delay for the relay signal to reach secondary device R2 with the information. Thus, for synchronization of the information timing, the system may employ delay in the primary device R1 to account for the extra time to relay the information to secondary device R2.

This additional relaying option demonstrates the flexibility of the system. Other relaying modes are possible without departing from the scope of the present subject matter.

In the various relaying modes provided herein, relaying may be performed in a variety of different embodiments. In one embodiment, the relaying is unidirectional. In one embodiment the relaying is bidirectional. In one embodiment, relaying of audio information is unidirectional and control information is bidirectional. Other embodiments of programmable relaying are possible involving combinations of unidirectional and bidirectional relaying. Thus, the system is highly programmable to adapt to a number of communication requirements and applications.

Figure 4A:
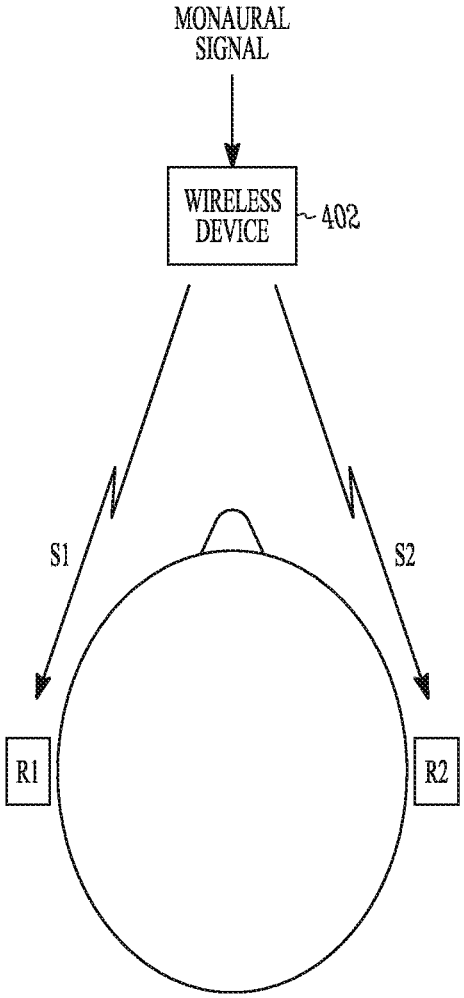
FIG. 4A shows one system providing multiple signals according to one embodiment of the present subject matter.

FIG. 4A shows one system providing multiple signals according to one embodiment of the present subject matter. This system demonstrates that phase and/or level adjustment may be performed at the wireless device 402 to provide a first signal S1 and a second signal S2 from a single monaural signal. In some embodiments, the signals S1 and S2 are adjusted to the desired interaural phase/time delay and interaural level differences by wireless device 402 and then played to the wearer of R1 and R2 without further adjustments to the phase and/or level. In some embodiments, further adjustment of the interaural phase/time delay and/or interaural level can be performed by either R1 or R1 or both in combination. The adjustments to interaural phase/time delay and/or interaural level are controllable by inputs to the wireless device 402 and many of the same applications can be performed as set forth herein.

Figure 4B:
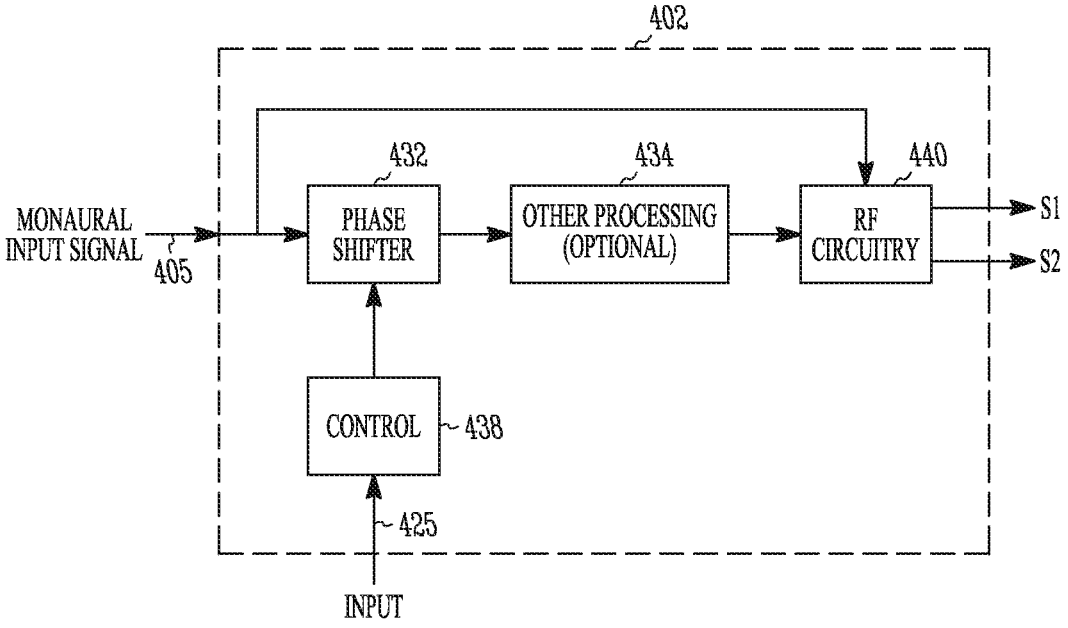
FIG. 4B shows a signal flow of a wireless audio controller according to one embodiment of the present subject matter.

FIG. 4B shows a signal flow of a wireless audio controller according to one embodiment of the present subject matter. In this example, the monaural input signal 405 is processed by phase shifter 432 to provide a phase shifted version of the input signal 405. In various embodiments, the phase shift arises from a constant time delay applied to input signal 405. In various embodiments, the phase shift arises from a constant phase shift at all frequencies applied to input signal 405. In various embodiments, the phase shift arises from a phase shift that is varying as a function of frequency. Thus, control 438 provides some form of setting for adjusting phase shift and/or for selecting the type of phase shift to be applied. In one embodiment, the signal 425 is provided by a source external to the hearing assistance device R1 to control the phase shift. Various means for supplying signal 425 include one or more of switches operable by a user, soft switches programmed by a programming device, or any combination of such inputs. Furthermore, in various embodiments, signal 425 may be internally generated by systems within the programming device to provide phase shift control as a function of one or more of sound received, conditions detected, and other processes requiring a change of either phase shift amount and/or mode. The signal 425 may also be transmitted and received by the device to adjust its operation.

The phase adjusted signal may also be further processed using processor 434. The resulting signal is sent to radio transmitter 440 to provide S1 and S2 with the desired interaural phase/time delay and interaural level adjustments. Thus, the phase shifter circuitry is located at the wireless device 402 in this embodiment. In various embodiments, the wireless device 402 includes one or more of the interface embodiments demonstrated in U.S. Provisional Patent Application Ser. No. 60/687,707, filed Jun. 5, 2005, entitled: COMMUNICATION SYSTEM FOR WIRELESS AUDIO DEVICES, and U.S. patent application Ser. No. 11/447,617, filed Jun. 5, 2006, entitled: COMMUNICATION SYSTEM FOR WIRELESS AUDIO DEVICES which claims the benefit of U.S. Provisional Application Ser. No. 60/687,707, the entire disclosures of which are hereby incorporated by reference. The functionalities of the wireless audio controller can be combined with the phase/time delay and level adjusting features described herein. Various different inputs may be used in combination to perform phase/time delay adjustment control and interaural level adjustment control.

The system of FIG. 4 can perform many of the applications set forth above for those systems of FIGS. 1-3. Furthermore, the systems may work in conjunction to provide interaural phase/time delay and interaural level adjustment of the signals for a variety of applications. Various different inputs may be used in combination to perform phase/time delay adjustment control and interaural level adjustment control.

The following discussion applies to all of the embodiments set forth herein. For audio applications including speech, a number of modes exist for binaural presentation of speech to the primary device and secondary device. Binaural speech information can greatly enhance intelligibility of speech. This is especially so when speech has been distorted through a vocoder and when the wearer is attempting to listen in a noisy environment. The following modes also provide other advantages to speech information, such as loudness summation and a release of masking making the speech more understandable in a noisy environment.

1) Coherent Signals: When signals are coherent, the signals provided to a wearer of, for example, a hearing aid receiving signals via the DAI interfaces are identical, producing a perception of centered sound to the user. Such speech would be diotic.

2) Incoherent Signals: A phase shift is applied across the spectrum of the signal either in the primary or the secondary device. For example, the speech signal in the secondary device could be inverted, equivalent to providing a 180 degree phase shift at all frequencies. The binaural speech will be perceived as diffuse and may be preferred by the wearer over the centered, diotic speech associated with coherent signals (above). The speech in the case of incoherent signals is dichotic. Those of skill in the art will know that many phase adjustments can be made to achieve a diffuse perception, including a constant change across frequency of a phase value other than 180 degrees, and a frequency-varying phase change. Time-domain filters, such as all-pass filters, can also be used to adjust the phase of the signal without the use of time-to-frequency conversion. One approach to providing such a phase shift includes conversion of the time domain signals processed by the system into frequency domain signals and then application of a predetermined phase to create the 180 degree shift for all frequencies of interest.

3) Lateralized Signals: A delay and/or attenuation is applied to the speech in either the primary or secondary device in order for the speech to be perceived as coming from the side that did not receive the delay and/or attenuation. Typical numbers include, but are not limited to, a one millisecond delay and a one decibel attenuation. Typical ranges of delay include, but are not limited to, 0.3 milliseconds to 10 milliseconds. One such other range includes 0.2 milliseconds to 5 milliseconds. Typical attenuation ranges include, but are not limited to, 1 decibel and 6 decibels. One such other range includes 1 decibel to 10 decibels. Other delays and attenuations may be used without departing from the scope of the present subject matter. A listener may prefer, for example, a one millisecond delay and a one decibel attenuation, since speech from, for example, a cell phone, is normally heard in one ear and since the perceived sound will be in one ear, yet retain the benefits of having a binaural signal to the listener. In various embodiments, the attenuations and delays are programmed by the dispensing professional using hearing aid fitting software. So, different patients could have different parameters set according to their preference. Some patients may prefer diffuse sound, some may prefer sound to their left, some may prefer sound to their right, etc.

The wearer's voice in various embodiments can be transmitted back to the wireless device. For example, in cases where the wireless device is a cell phone and the primary and secondary wireless hearing assistance devices are hearing aids, it is understood that the communications back to the cell phone by the aids include:

1) In one embodiment, the primary device (e.g., hearing aid) paired with the wireless device (e.g., cell phone) transmits the wearer's voice back to the wireless device (cell phone) and does not transmit this to the secondary device (e.g., other hearing aid). Thus, no voice pickup is used by the secondary device and no transmission of the wearer's voice is made from secondary device to primary device.

2) In one embodiment, the secondary device (e.g., other hearing aid) does transmit audio to the primary device (e.g., hearing aid paired with the cell phone).

In varying embodiments, the signals picked up from the primary device and secondary device can be processed in a variety of ways. One such way is to create a beamformed signal that improves overall signal-to-noise ratio that is transmitted back to the wireless device (e.g., cell phone). A delay would be added to the primary voice-pickup signal before effective combination with the secondary voice signal. Such a system can steer the beam to a location orthogonal to the axis formed by a line connecting primary and secondary, i.e., the direction of maximum sensitivity of the beamformed signal can be set at the location of the wearer's mouth. In addition to beam forming, noise cancellation of uncorrelated noise sources can be accomplished. In one application, such cancellation can take place by the primary device prior to transmission to the wireless device. These techniques improve the signal-to-noise ratio and quality of the signal received by a person listening to the signals from the wireless device (e.g., a person at the other end of the communication, for example, at another telephone).

It is understood that the present phase shifter could be replaced with a processor offering a head-related transfer function (HRTF) which performs phase and level changes as a function of frequency that are specific to the acoustic transfer function from a free field source to the ear of the listener. Such processing could be accomplished using a digital signal processor or other dedicated processor.

It is understood that the examples set forth herein can be applied to a variety of wireless devices and primary and secondary device combinations. Thus, the examples set forth herein are not limited to telephone applications. It is further understood that the wireless devices set forth herein can be applied to right and left hearing applications as desired by the user and is not limited to any one direction of operation.

This description has set forth numerous characteristics and advantages of various embodiments and details of structure and function of various embodiments, but is intended to be illustrative and not intended in an exclusive or exhaustive sense. Changes in detail, material and management of parts, order of process and design may occur without departing from the scope of the appended claims and their legal equivalents.

What is claimed is:

1. A method for providing a sound to a listener having first and second ears, the method comprising:

receiving a monaural information signal;

converting the monaural information signal into first and second output signals using a processor, including introducing a phase difference between the first and second output signals;

receiving a control signal;

adjusting the phase difference using the control signal; and providing the sound to the listener to be perceived by the listener as a binaural sound having an interaural difference, including:

providing a first sound based on the first output signal to the first ear using a first speaker; and providing a second sound based on the second output signal to the second ear using a second speaker.

2. The method of claim 1, further comprising varying the phase difference as a function of frequency.

3. The method of claim 1, further comprising adjusting the phase difference using time-domain filters.

4. The method of claim 1, further comprising adjusting the phase difference based on a head-related transfer function.

5. The method of claim 1, wherein receiving the control signal comprises receiving the control signal from one or more switches operable by the listener.

6. The method of claim 1, wherein converting the monaural information signal into the first and second output signals further comprises introducing a level difference between the first and second output signals, and further comprising adjusting the level difference using the control signal.

7. The method of claim 1, wherein receiving the control signal comprises receiving a signal indicating a telephone in proximity or ringing.

8. The method of claim 7, comprising lateralizing the binaural sound perceived by the listener in response to the control signal indicating the telephone in proximity.

9. The method of claim 1, wherein receiving the monaural information signal comprises receiving the monaural information signal from a wireless device.

10. The method of claim 9, wherein receiving the monaural information signal from the wireless device comprises receiving the monaural information signal from a cell phone.

11. The method of claim 9, wherein receiving the monaural information signal from the wireless device comprises receiving the monaural information signal as packetized audio from a wireless audio controller.

12. The method of claim 9, further comprising transmitting the listener's voice to the wireless device.

13. A system for providing a sound to a listener having first and second ears, the system comprising:

a processor configured to receive a monaural information signal, to convert the monaural input signal into first and second output signals with a phase difference between the first and second output signals, to receive a control signal, and to adjust the phase difference using the control signal; and a pair of audio devices configured to provide the sound to the listener as a binaural sound having an interaural difference perceivable by the listener, the pair of audio devices including:

a first speaker configured to provide a first sound to the first ear based on the first output signal; and a second speaker configured to provide a second sound to the second ear based on the second output signal.

14. The system of claim 13, wherein the processor is further configured to convert the monaural input signal into the first and second output signals with a level difference and to adjust the level difference using the control signal.

15. The system of claim 13, further comprising a radio receiver coupled to the processor and configured to receive the monoaural information signal wirelessly and to transmit the wirelessly received monoaural information signal to the processor.

16. The system of claim 13, wherein the processor is configured to generate a head-related transfer function and to control the phase difference based on the head-related transfer function.

17. The system of claim 13, further comprising one or more switches configured to receive the control signal from the listener.

18. The system of claim 13, wherein the processor is configured to adjust the phase difference using time-domain filters.

19. The system of claim 13, wherein the pair of audio devices comprises pair of first and second hearing assistance devices, the first hearing assistance device including the first speaker, the second hearing assistance device including the second speaker.

20. The system of claim 19, wherein the pair of first and second hearing assistance devices comprises a pair of first and second hearing aids.

* * * * *